US011432663B2

(12) United States Patent
Chapuis et al.

(10) Patent No.: US 11,432,663 B2
(45) Date of Patent: Sep. 6, 2022

(54) ADJUSTABLE APPARATUSES THAT SECURE TABLET COMPUTING DEVICES AND KEYBOARDS TO DISPLAY TABLES

(71) Applicant: OnQ Solutions, Inc., Hayward, CA (US)

(72) Inventors: Paul F. Chapuis, Woodside, CA (US); William B. Tenney, Hayward, CA (US); Thomas M. Hopmans, Davis, CA (US); Steven D. Penny, Oakland, CA (US)

(73) Assignee: OnQ Solutions, Inc., Hayward, CA (US)

( * ) Notice: Subject to any disclaimer, the term of this patent is extended or adjusted under 35 U.S.C. 154(b) by 0 days.

(21) Appl. No.: 16/932,499

(22) Filed: Jul. 17, 2020

(65) Prior Publication Data

US 2021/0015274 A1 Jan. 21, 2021

Related U.S. Application Data

(60) Provisional application No. 62/875,776, filed on Jul. 18, 2019.

(51) Int. Cl.

| | |
|---|---|
| ***F16M 11/00*** | (2006.01) |
| ***A47F 7/00*** | (2006.01) |
| ***A47B 21/04*** | (2006.01) |

(52) U.S. Cl.

CPC ..... *A47F 7/00* (2013.01); *A47B 21/04* (2013.01)

(58) Field of Classification Search

CPC ..... H04M 1/04; G06F 1/1632; A47F 7/00; A47B 21/04; F16M 11/041

See application file for complete search history.

(56) References Cited

U.S. PATENT DOCUMENTS

| | | | | |
|---|---|---|---|---|
| 5,859,762 | A * | 1/1999 | Clark | F16M 11/10 361/679.41 |
| 6,700,488 | B1 | 3/2004 | Leyden et al. | |
| 7,187,283 | B2 | 3/2007 | Leyden et al. | |
| 7,474,524 | B1 * | 1/2009 | Shaw | B41J 29/026 312/223.1 |
| 8,191,851 | B2 | 6/2012 | Crown | |
| 8,360,373 | B2 | 1/2013 | Johnson et al. | |
| 8,701,452 | B2 | 4/2014 | Foster et al. | |
| 8,814,128 | B2 | 8/2014 | Trinh et al. | |

(Continued)

OTHER PUBLICATIONS

Gripzo, "iPad Enclosure", https://www.gripzo.com/en/products/tablets/ipad-enclosure, downloaded on Jun. 11, 2018.

(Continued)

*Primary Examiner* — Amy J. Sterling

(74) *Attorney, Agent, or Firm* — Vierra Magen Marcus LLP

(57) ABSTRACT

An apparatus for securing computing devices and keyboards to a display table. The apparatus may be adjustable to accommodate computing devices of different sizes and keyboards of different sizes. The apparatus includes a number of individual components which assemble together around the computing device and keyboard in such a way that, once assembled to the display table, the individual components may not be adjusted or removed, thus securing the computing device and keyboard to the display table.

25 Claims, 21 Drawing Sheets

(56) References Cited

U.S. PATENT DOCUMENTS

| | | | | |
|---|---|---|---|---|
| 8,833,716 | B2 * | 9/2014 | Funk | F16M 13/022 248/316.4 |
| 8,864,089 | B2 | 10/2014 | Hung | |
| 8,925,886 | B2 | 1/2015 | Sears | |
| 8,985,544 | B1 | 3/2015 | Gulick, Jr. | |
| 8,998,048 | B1 | 4/2015 | Wu | |
| 9,022,337 | B2 * | 5/2015 | Petruskavich | F16M 11/08 248/316.4 |
| 9,039,785 | B2 | 5/2015 | Gulick, Jr. | |
| 9,097,380 | B2 | 8/2015 | Wheeler | |
| 9,159,309 | B2 | 10/2015 | Liu et al. | |
| 9,161,466 | B2 * | 10/2015 | Huang | F16M 11/105 |
| 9,285,832 | B2 | 3/2016 | Galant | |
| 9,567,776 | B2 | 2/2017 | Moock et al. | |
| 9,568,141 | B1 * | 2/2017 | Zaloom | F16M 11/24 |
| 9,714,528 | B2 | 7/2017 | Van Balen | |
| 9,936,823 | B2 | 4/2018 | Galant | |
| 9,999,296 | B1 * | 6/2018 | Fan | F16M 11/38 |
| 10,060,572 | B1 * | 8/2018 | Don | H05K 7/14 |
| 10,165,873 | B2 | 1/2019 | Gulick, Jr. et al. | |
| 10,448,759 | B1 | 10/2019 | Chapuis et al. | |
| 10,646,055 | B2 | 5/2020 | Chapuis et al. | |
| 11,122,917 | B2 * | 9/2021 | Chapuis | A47F 5/10 |
| 2009/0127418 | A1 * | 5/2009 | Wang | F16M 13/00 248/310 |
| 2010/0079285 | A1 | 4/2010 | Fawcett et al. | |
| 2010/0108828 | A1 | 5/2010 | Yu et al. | |
| 2010/0148030 | A1 | 6/2010 | Lin | |
| 2012/0037783 | A1 | 2/2012 | Alexander et al. | |
| 2012/0234055 | A1 | 9/2012 | Bland, III et al. | |
| 2013/0301216 | A1 * | 11/2013 | Trinh | A47F 7/0246 361/679.58 |
| 2013/0318639 | A1 | 11/2013 | Gulick, Jr. | |
| 2014/0060218 | A1 | 3/2014 | Bisesti et al. | |
| 2014/0246551 | A1 * | 9/2014 | Springer | F16M 11/2021 248/276.1 |
| 2015/0089675 | A1 | 3/2015 | Gulick, Jr. | |
| 2015/0108948 | A1 | 4/2015 | Gulick, Jr. et al. | |
| 2015/0196140 | A1 | 7/2015 | Lin | |
| 2015/0300050 | A1 | 10/2015 | Van Balen | |
| 2017/0049251 | A1 | 2/2017 | Gulick, Jr. et al. | |
| 2017/0188724 | A1 | 7/2017 | Lin | |
| 2018/0058107 | A1 | 3/2018 | Lucas et al. | |

OTHER PUBLICATIONS

Gripzo, "iPhone", https://www.gripzo.com/en/products/smartphones/iphone, downloaded on Jun. 11, 2018.

Scorpion Security Products, "4-Point ERS Phone Scorpion", https://www.scorpionsecurityproducts.com/product/4-point-ers-phone-scorpion/, downloaded on Jun. 11, 2018.

Scorpion Security Products, "4-Point ERS Small Tablet Scorpion", https://www.scorpionsecurityproducts.com/product/4-point-ers-small-tablet-scorpion/, downloaded on Jun. 11, 2018.

Dongguan Comer Electronic Technology Co., Ltd., "Comer Anti-Theft Locking Laptop Mechanical Security Display Frame for Mobile Phone Stores", http://www.comerdisplay.com/sale-8024631-comer-anti-theft-locking-laptop-mechanical-security-display-frame-for-mobile-phone-stores.html, downloaded on Jun. 11, 2018.

Dongguan Comer Electronic Technology Co., Ltd., "Comer Universal Display Mechanical Anti-Theft Security Display Locking System for Tablet Brackets", http://www.smartcomer.com/sale-8028445-comer-universal-display-mechanical-anti-theft-security-display-locking-system-for-tablet-brackets.html, downloaded on Jun. 11, 2018.

RTF, "Vise—Securely and Attractively Placing Your Product First", http://www.rtfglobal.com/products/vise-cell-phone-security/, downloaded on Jun. 11, 2018.

RTF, "Smartphones—Samsung Note 3, LG Flex, HTC One, Apple iPhone 5, Blackberry Z10", http://www.rtfglobal.com/solutions/by-devices-type/smartphones/#!prettyPhoto, downloaded on Jun. 11, 2018.

Gripzo, "Universal Smartphone Grip/ Universal Tablet Grip", https://www.gripzo.com/en/products/smartphones/iphone, downloaded on Jun. 14, 2018.

Non-Final Office Action dated Jun. 12, 2019, U.S. Appl. No. 16/006,092 dated Jun. 12, 2018.

Response to Office Action dated Jul. 2, 2019, U.S. Appl. No. 16/006,092, filed Jun. 12, 2018.

Notice of Allowance dated Jul. 25, 2019, U.S. Appl. No. 16/006,092 dated Jun. 12, 2018.

Post Allowance Amendment under 37 CFR 1.312 dated Jul. 29, 2019, U.S. Appl. No. 16/006,092, filed Jun. 12, 2018.

Preliminary Amendment dated Oct. 8, 2019, U.S. Appl. No. 16/575,157.

Non-final Office Action dated Oct. 11, 2019, U.S. Appl. No. 16/575,157.

Notice of Allowance dated Feb. 25, 2020, U.S. Appl. No. 16/575,157.

U.S. Appl. No. 16/572,296 dated Sep. 16, 2019.

* cited by examiner

ADJUSTABLE APPARATUSES THAT SECURE TABLET COMPUTING DEVICES AND KEYBOARDS TO DISPLAY TABLES

CLAIM OF PRIORITY

The present application claims priority to U.S. Provisional Patent Application No. 62/875,776 entitled, "ADJUSTABLE APPARATUSES THAT SECURE TABLET COMPUTING DEVICES AND KEYBOARDS TO DISPLAY TABLES," filed Jul. 18, 2019, which application is incorporated by reference herein in its entirety.

FIELD OF TECHNOLOGY

Embodiments of the present technology relate to apparatuses that secure table computing devices and keyboards to display tables.

BACKGROUND

Tablet computing devices, which can also be referred more succinctly herein as tablet computers or simply tablets, are often sold in retail stores. While tablets often include touch screens, they often can be used with keyboards that are selectively attachable/detachable to/from the tablets. Such keyboards enable the tablets to function similar to laptop computers, making it easier and faster for users to type.

To enable customers to view, touch, and interface with a tablet and keyboard attached thereto, such devices may be displayed on a display table in a retail store, in which case they are preferably secured to the display table to prevent theft. While there exist various types of apparatuses for securing tablets to display tables, such apparatuses do not allow for a keyboard to be attached to a secured tablet and do not also secure a keyboard to a display table.

BRIEF DESCRIPTION OF THE DRAWINGS

The invention will be described with respect to the particular embodiments thereof. Other objects, features, and advantages of the invention will become apparent with reference to the specification and drawings in which.

DETAILED DESCRIPTION

The present technology will now be described with reference to the figures, which in general relate to an apparatus for securing computing devices and keyboards to a display table. In embodiments, the apparatus is adjustable to accommodate computing devices of different sizes and keyboards of different sizes. The apparatus includes a number of individual components which assemble together around the computing device and keyboard in such a way that, once assembled to the display table, the individual components may not be adjusted or removed, thus securing the computing device and keyboard to the display table.

It is understood that the present invention may be embodied in many different forms and should not be construed as being limited to the embodiments set forth herein. Rather, these embodiments are provided so that this disclosure will be thorough and complete and will fully convey the invention to those skilled in the art. Indeed, the invention is intended to cover alternatives, modifications and equivalents of these embodiments, which are included within the scope and spirit of the invention as defined by the appended claims. Furthermore, in the following detailed description of the present invention, numerous specific details are set forth in order to provide a thorough understanding of the present invention. However, it will be clear to those of ordinary skill in the art that the present invention may be practiced without such specific details.

The terms "top" and "bottom," "upper" and "lower" and "vertical" and "horizontal" as may be used herein are by way of example and illustrative purposes only, and are not meant to limit the description of the invention inasmuch as the referenced item can be exchanged in position and orientation. Also, as used herein, the terms "substantially" and/or "about" mean that the specified dimension or parameter may be varied within an acceptable manufacturing tolerance for a given application.

Figure 1:
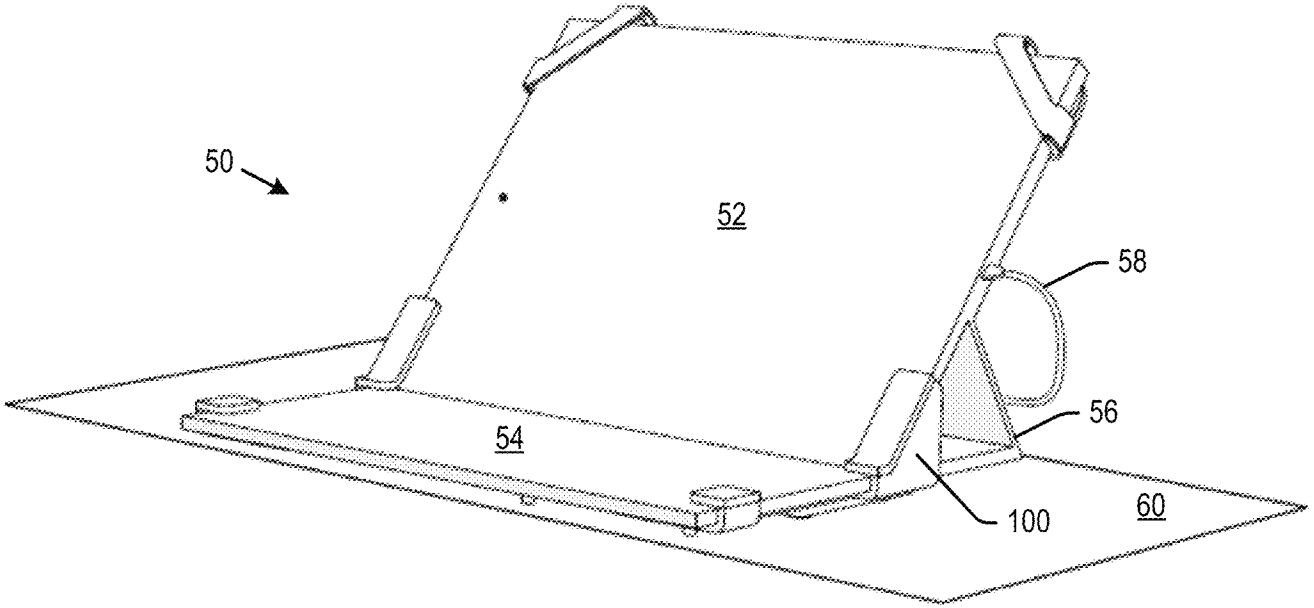
FIG. 1 is a perspective view of an apparatus according to embodiments of the present technology securing the computing device to a display table.

FIG. 1 illustrates a sample device 50, including a display/touchscreen (in the form of a tablet) 52 and keyboard 54 affixed to a display table 60 by an apparatus 100 according to the present technology. The device further includes a cover 56 and a power cord 58. Since the apparatus 100 is adjustable such that it can be used with tablets 52 and keyboards 54 of different sizes (i.e., dimensions), the apparatus 100 can also be referred to as an adjustable apparatus.

Exemplary tablets 52 that can be secured using the apparatus 100 of the present technology include various models of the iPad™ (available from Apple Inc. headquartered in Cupertino, Calif.), the Surface™ (available from Microsoft Corporation, headquartered in Redmond Wash.), the Galaxy Book™ (available from Samsung. headquartered in Seoul, South Korea), just to name a few. The keyboard 54 may attach to the tablet 52. Such keyboards 54 may be manufactured and sold by the manufacturer of the tablet, and/or by third-party manufacturers and sellers.

Figure 2A:
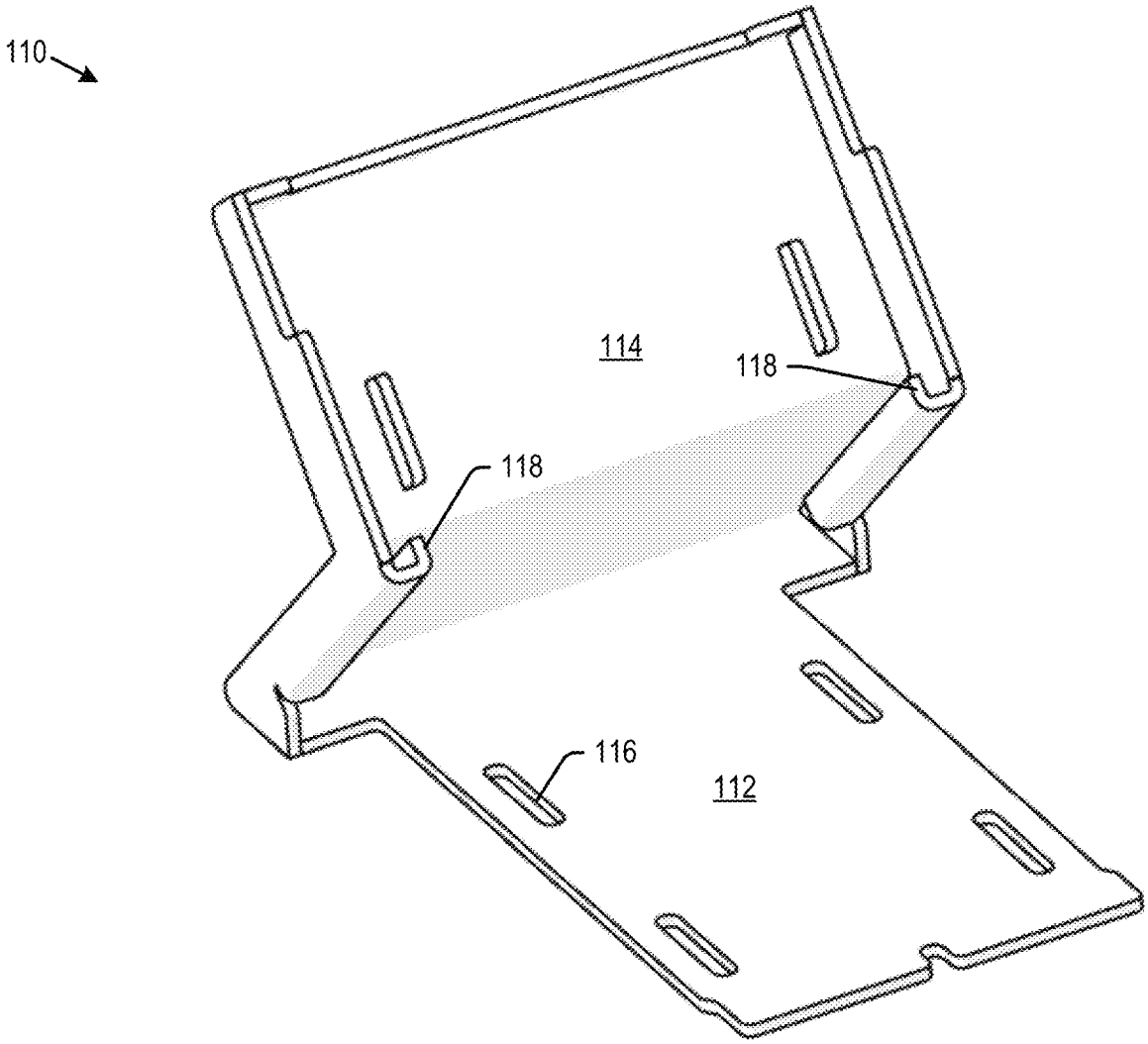
FIGS. 2A-2H are perspective views of different components of the apparatus according to embodiments of the present technology.

FIGS. 2A-2H illustrate various parts of the apparatus 100 introduced in FIG. 1. FIG. 2A shows a bottom cover plate 110 including a base section 112 and a cover section 114 formed at an angle the base section 112. As explained hereinafter, base section 112 lies adjacent a top surface of the display table 60 once the apparatus 100 is assembled and installed on the table 60. Screws 124 (FIG. 4) fit through screw holes 116 to fix the apparatus 100 to a display table 60. As is also explained hereinafter, the cover section 114 includes slots 118 that are engaged by rails 128 of a baseplate 120 (FIG. 2B) so that the base section 112 and cover section 114 cover and prevent access to components of the apparatus 100 once it is assembled.

Figure 2B:
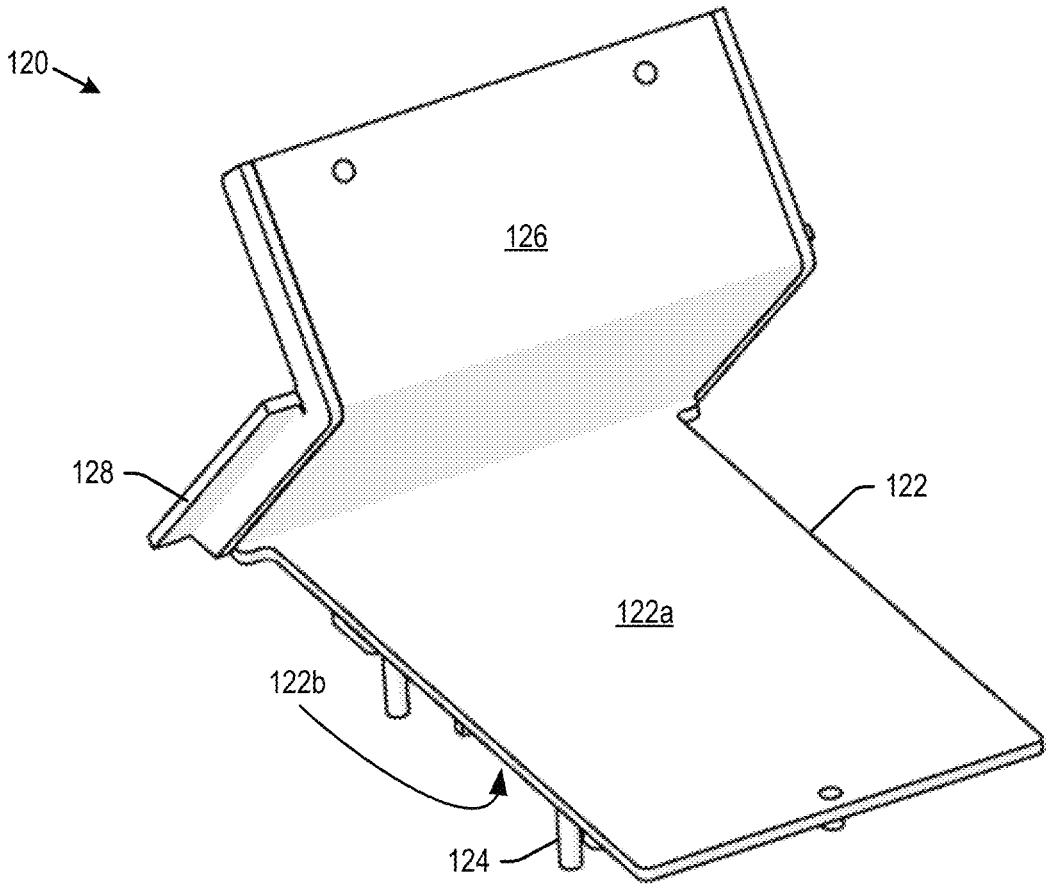
Figure 4:
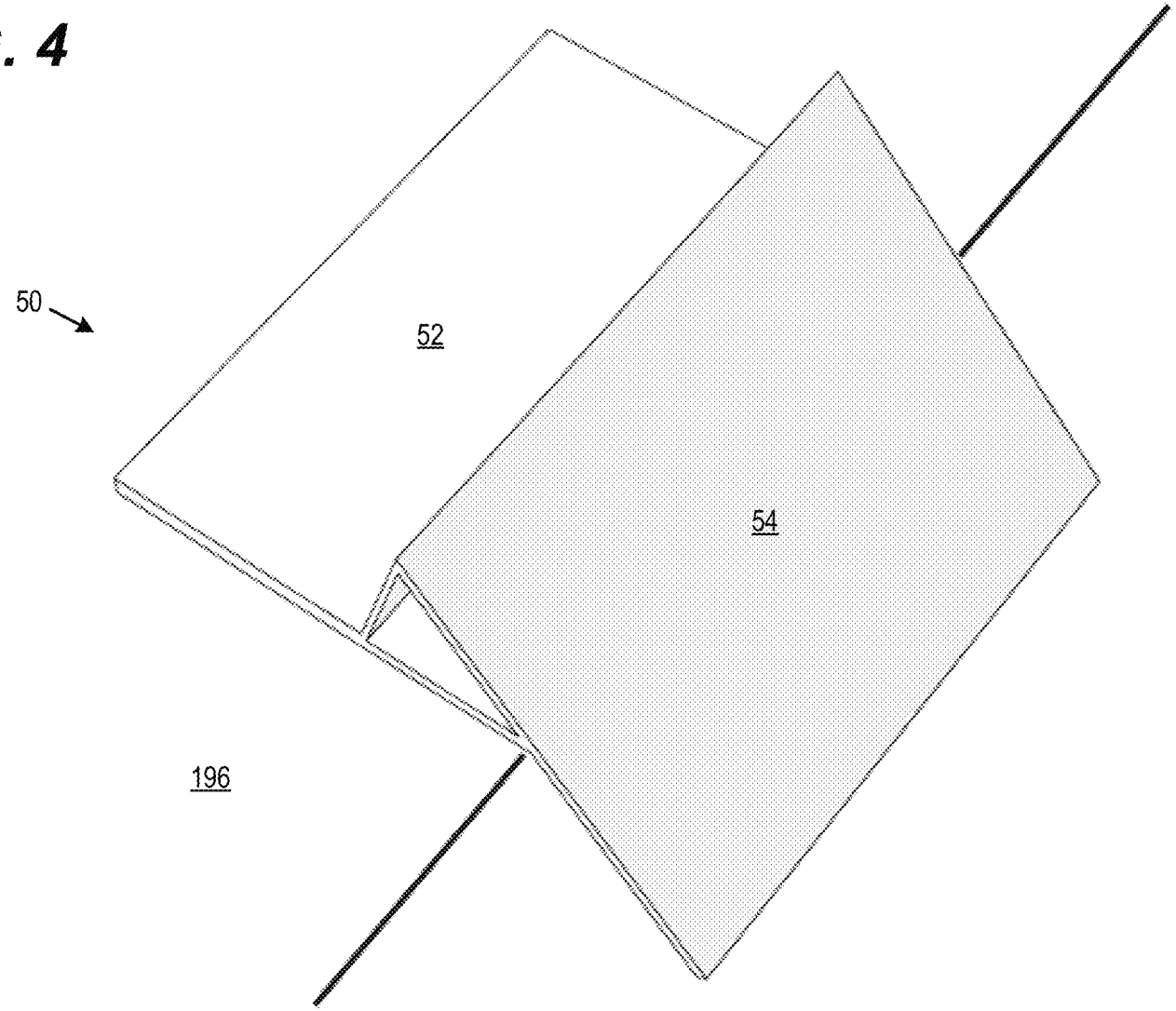
FIG. 4 is a perspective view of a computing device positioned for receiving an apparatus according to embodiments of the present technology.

FIG. 2B shows a front perspective view of the baseplate 120, and FIG. 4 shows a rear perspective view of the baseplate 120. Baseplate 120 includes a base 122 including a front surface 122*a* (FIG. 2B) and a rear surface 122*b* (FIG. 4). The baseplate rear surface 122*b* includes a number of screws 124 that fit through holes 116 (FIG. 2A) in the bottom cover plate 110 to allow the apparatus 100 to be affixed to the display table 60. While four such screws 124 are shown, the baseplate may include less than four screws in further embodiments.

The baseplate 120 further includes a cover plate 126 formed at an angle to the base 122. The cover plate 126 includes a pair of rails 128 that engage within slots 118 of the bottom cover plate 110 as mentioned above and explained in greater detail below.

Referring to the rear view of baseplate 120 shown in FIG. 4, the rear surface 122*b* of base 122 further includes a pair of spaced apart rows, or racks, of teeth 130. As explained below, the racks of teeth 130 are provided to mesh with teeth 169 and 179 of left and right bottom corner clips 160 and 170, respectively (FIGS. 2E and 2F). As explained below, the provision of teeth 130 meshing with teeth 169, 179 allows the lateral positions of the left and right bottom corner clips 160, 170 to be adjusted (along axis 132) based on the size of the keyboard 54.

The rear surface of cover plate 126 further includes a pair of spaced apart racks of teeth 134. As explained below, the racks of teeth 134 are provided to mesh with teeth 182 of the back support plate 180 (FIGS. 2G and 2H). As also explained below, the provision of teeth 134 meshing with teeth 182 allows the height of the back support plate 180 to be adjusted longitudinally based on the height of the tablet 52.

Figure 2C:
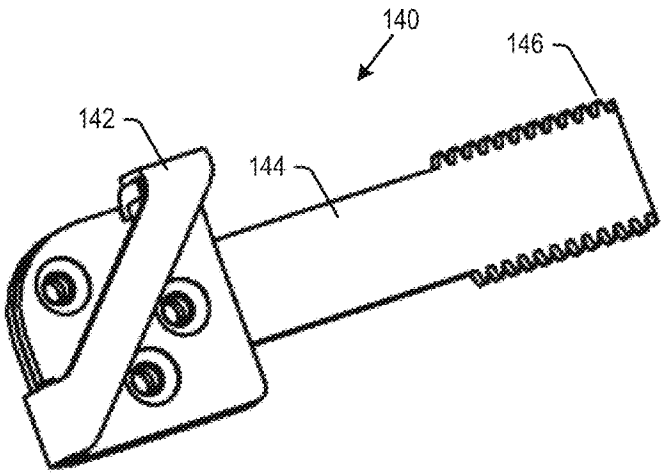
Figure 2D:
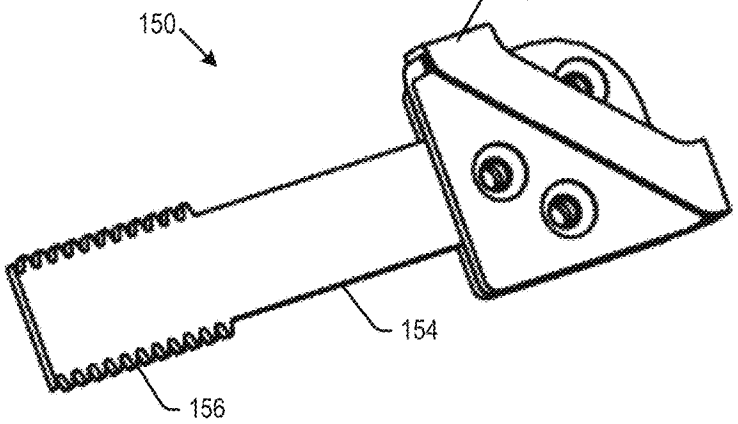
Figure 2F:
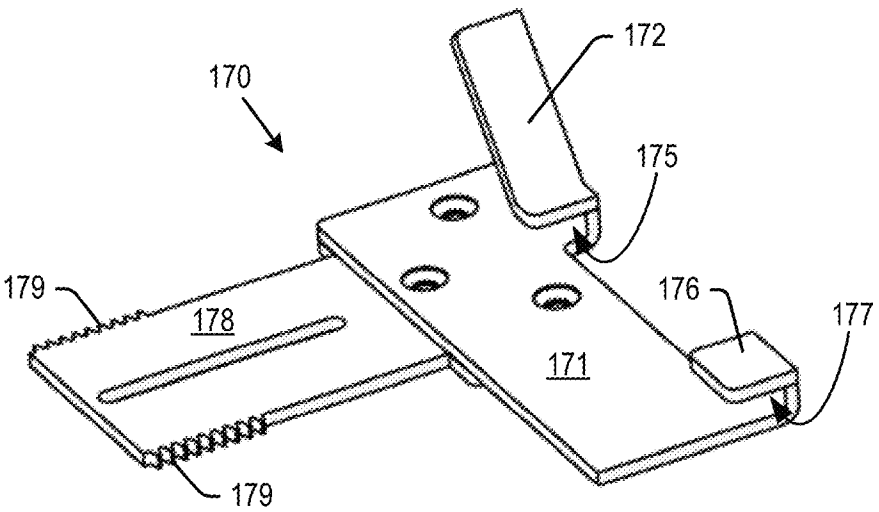
Figure 2E:
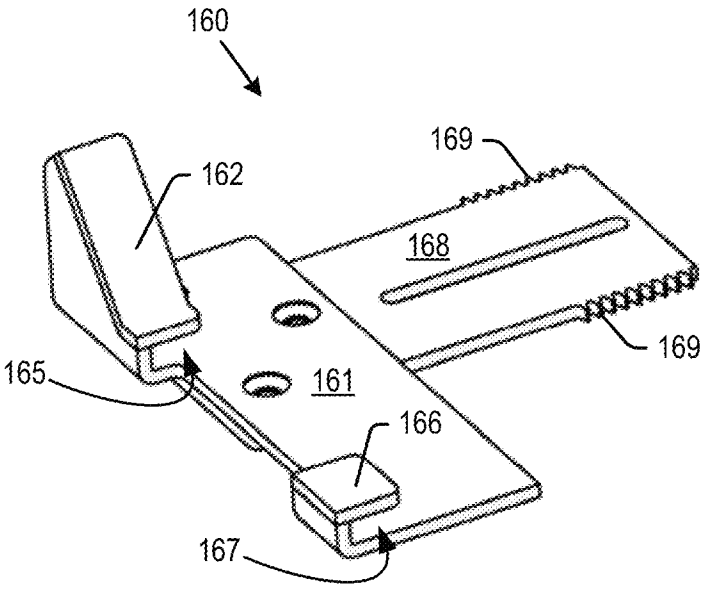
Figure 2H:
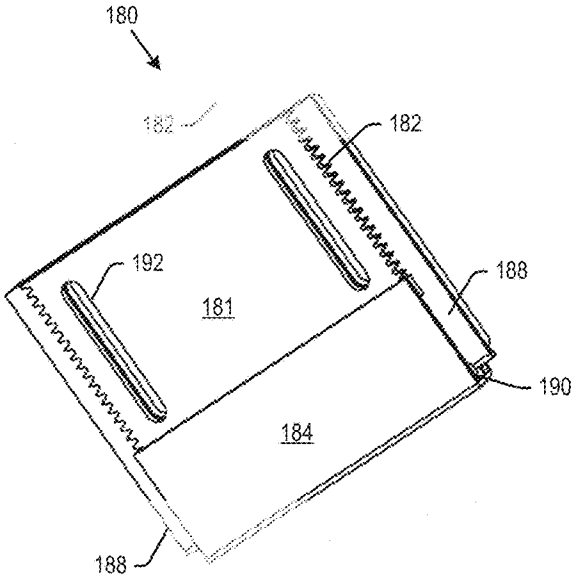
Figure 2G:
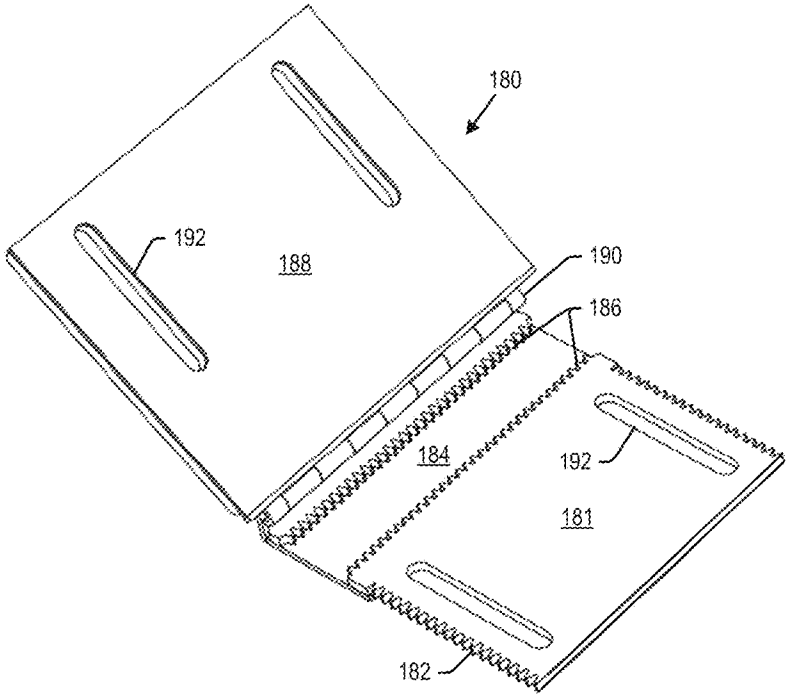

FIGS. 2C and 2D are perspective views of left and right top corner clips 140 and 150, respectively. The top corner clips 140 and 150 are provided to restrain the computing device along first and second orthogonal axes. That is, the top corner clips prevent movement of the computing device laterally, and the top corner clips prevent movement of the computing device up or down.

Left top corner clip 140 includes a bracket 142 for engaging a left, upper corner of tablet 52. FIG. 2C further shows a tooth plate 144 having a first end affixed to bracket 142 and a second end including a pair of spaced apart racks of teeth 146. As explained below, teeth 146 allow the left top corner clip 140 to be adjustably affixed to the back support plate 180 (FIGS. 2G, 2H) to accommodate tablets 52 different widths.

Right top corner clip 150 includes a bracket 152 for engaging a right, upper corner of tablet 52. FIG. 2D further shows a tooth plate 154 having a first end affixed to bracket 152 and a second end including a pair of spaced apart racks of teeth 156. As explained below, teeth 156 allow the right top corner clip 150 to be adjustably affixed to the back support plate 180 (FIGS. 2G, 2H) to accommodate tablets 52 different widths.

FIGS. 2E and 2F are perspective views of left and right bottom corner clips 160 and 170, respectively. Left bottom corner clip 160 includes a first plate 161 having a flange 162 mounted at an oblique angle with respect to plate 161. Flange 162 defines a triangular-shaped gap 165 between the flange 162 and plate 161. When the apparatus 100 is mounted around the computing device 50, the tablet 52 and keyboard 54 rest inside the triangular-shaped gap 165, at the interface where the tablet and keyboard come together and form an angle with each other. The flange 162 may be formed at a variety of oblique angles with respect to plate 161, including for example 30° to 60°, though other angles are possible. Plate 161 further includes a second flange 166 which may be formed generally parallel to the surface plate 161. Flange 166 defines a gap 167 which receives an edge of the keyboard 54 when the left bottom corner clip 160 is affixed to apparatus 100.

Plate 161 is affixed to a tooth plate 168, for example at a right angle. The plate 168 includes a pair of spaced apart racks of teeth 169. As explained below, teeth 169 allow the left bottom corner clip 160 to be adjustably affixed between the bottom cover plate 110 and baseplate 120 to accommodate tablets 52 of different widths.

Right bottom corner clip 170 includes a first plate 171 having a flange 172 mounted at an oblique angle with respect to plate 171. Flange 172 defines a triangular-shaped gap 175 between the flange 172 and plate 171. When the apparatus 100 is mounted around the computing device 50, the tablet 52 and keyboard 54 rest inside the triangular-shaped gap 175, at the interface where the tablet and keyboard come together and form an angle with each other. The flange 172 may be formed at a variety of oblique angles with respect to plate 171, including for example 30° to 60°, though other angles are possible. Plate 171 further includes a second flange 176 which may be formed generally parallel to the surface plate 171. Flange 176 defines a gap 177 which receives an edge of the keyboard 54 when the right bottom corner clip 170 is affixed to apparatus 100.

Plate 171 is affixed to a tooth plate 178, for example at a right angle. The plate 178 includes a pair of spaced apart racks of teeth 179. As explained below, teeth 179 allow the right bottom corner clip 170 to be adjustably affixed between the bottom cover plate 110 and baseplate 120 to accommodate tablets 52 of different widths.

FIGS. 2G and 2H are perspective views of the back support plate 180 in its open and closed positions, respectively. Referring initially to FIG. 2G, back support plate 180 includes a first plate 181 including a pair of spaced apart racks of teeth 182 at lateral edges of the plate 181. As mentioned above and explained in greater detail below, teeth 182 mesh with teeth 134 in the rear surface of baseplate 120 (FIG. 5) to allow the height of the back support plate 180 to be adjusted longitudinally based on the height of the tablet 52.

Plate 181 further includes a recess 184 including a pair of opposed racks of teeth 186. Teeth 186 mesh with teeth 146 and 156 of the left and right top corner clips 140, 150 to allow adjustment of the lateral positions of the left and right top corner clips 140, 150.

The first plate 181 is connected to a second plate 188 by a hinge 190. FIG. 2H shows the first plate 181 closed up on top of the second plate 188. Slots 192 are provided in both the first and second plates 181, 188, which slots 192 align with each other when the first plate 181 is closed on top of the second plate 188. The slots 192 allow vertical adjustment of the back support plate 180 via the teeth 182.

Figure 3:
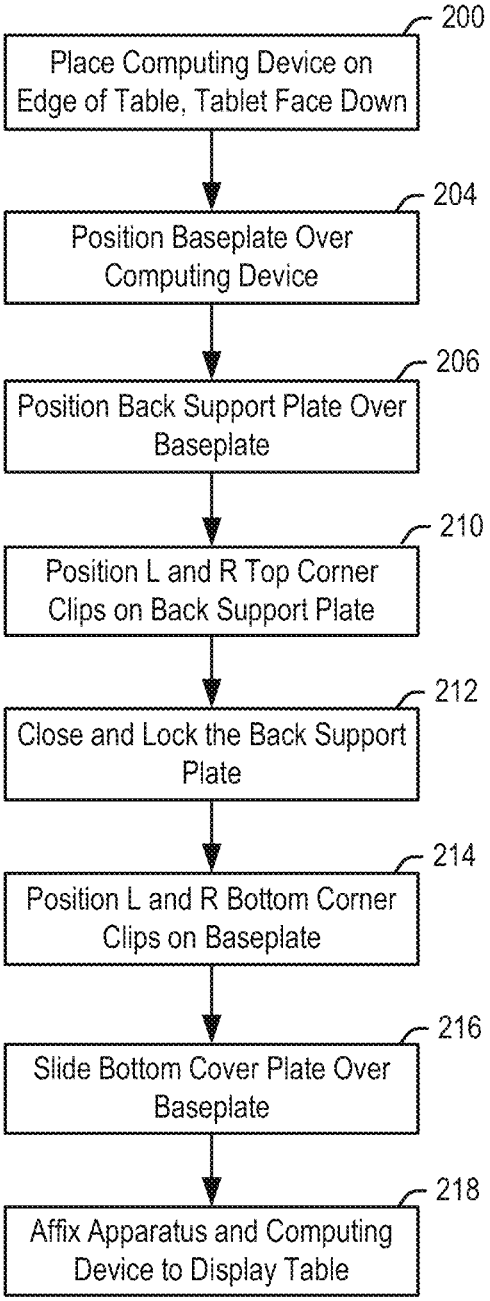
FIG. 3 is a flowchart illustrating the steps for the assembly and installation of the apparatus according to embodiments of the present technology.

Assembly of the above describe components in FIGS. 2A-2H will now be described with reference to the flowchart of FIG. 3 and the views of FIGS. 4-11B. In step 200, the computing device 50 may be placed at the edge of a table 196 as shown in FIG. 4 with a touch screen of the tablet 52 facing the table and the keyboard 54 overhanging an edge of the table at an angle for example as shown. Table 196 may or may not be the same as the display table 60.

Figure 5:
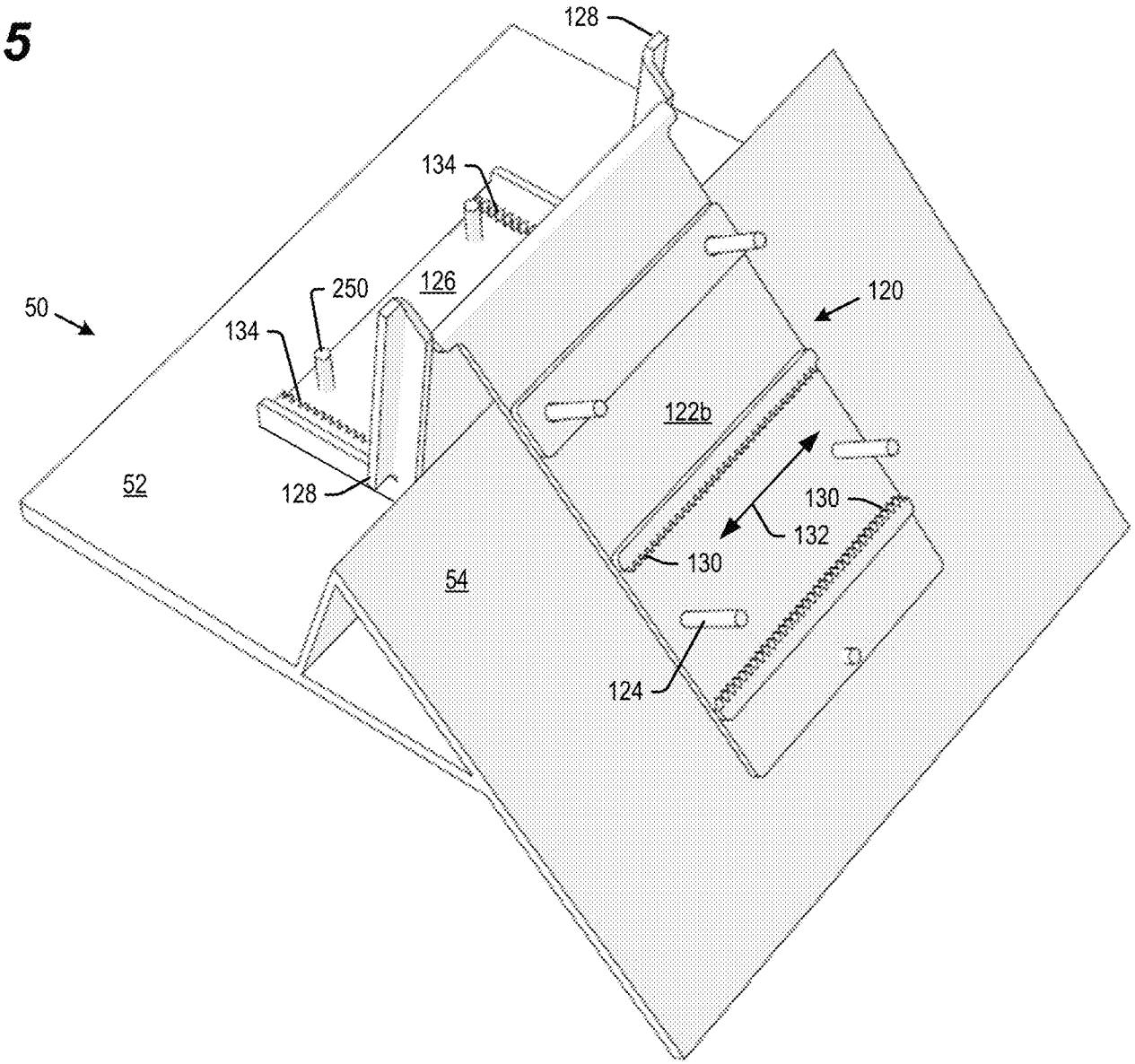
FIG. 5 is a perspective view of a baseplate of an apparatus according to embodiments of the present technology positioned on a computing device.

In step 204, the baseplate 120 may be positioned over the computing device 50 as shown in FIG. 5, with the front surface 122*a* of base 122 positioned against keyboard 54, and the cover plate 126 positioned against the tablet 52. The baseplate 120 may be centered laterally with respect to computing device 50.

Figure 6A:
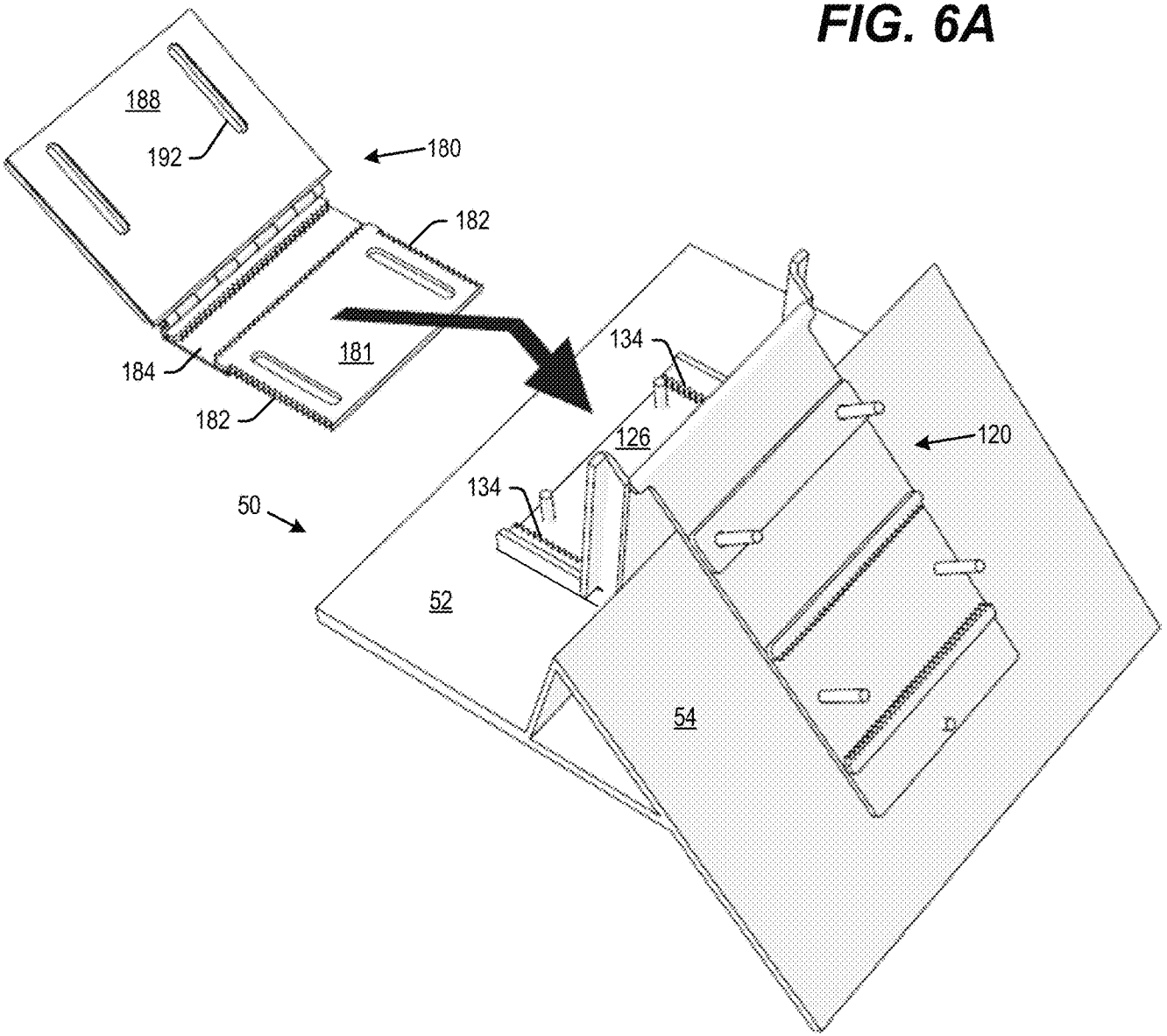
FIGS. 6A and 6B are perspective views showing a back support plate being mounted on a baseplate of an apparatus according to embodiments of the present technology.
Figure 6B:
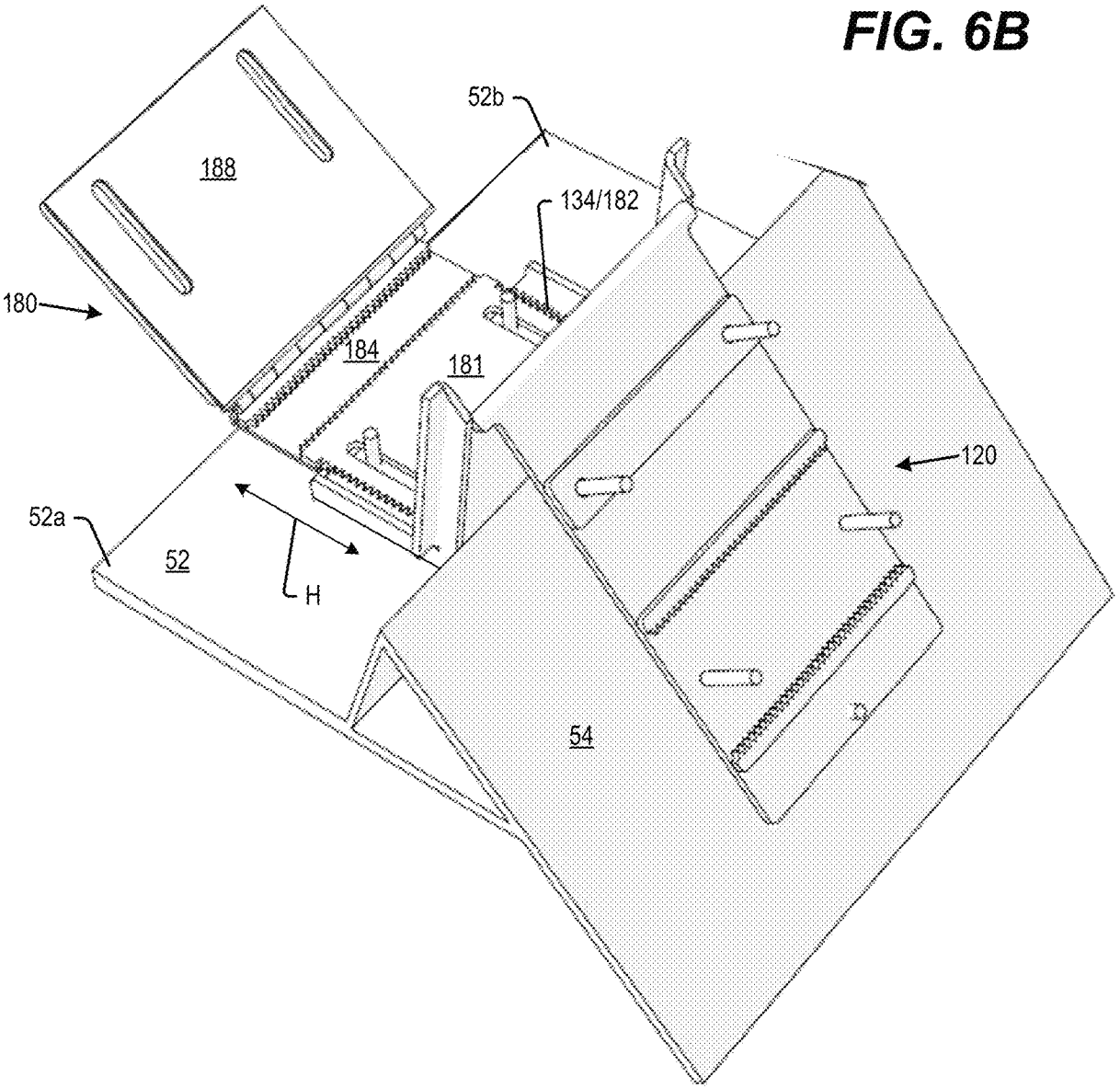

Thereafter, in step 206, the back support plate 180 (FIGS. 2G, 2H) may be placed over the cover plate 126 of baseplate 120 as shown in FIGS. 6A and 6B such that teeth 182 of the back support plate 180 mesh with teeth 134 of cover plate 126. As noted above, the tooth plates 144, 154 of the left and right top corner clips 140, 150 fit within the recess 184. The height of the back support plate 180 is adjustable along arrow H, i.e., longitudinally, to place the back support plate 180 at the correct height so that the brackets 142, 152 of the top corner clips 140, 150 align over the corners 52*a*, 52*b* of the tablet, as explained below. Once the proper height of the back support plate 180 is selected based on the height of the corners 52*a*, 52*b*, the height of the back support plate may be fixed by meshing teeth 182 of the back plate 180 with teeth 134 of the baseplate 120. Thus, the height of the clips 140, 150 may be adjusted to accommodate tablets 52 of different heights.

Figure 7A:
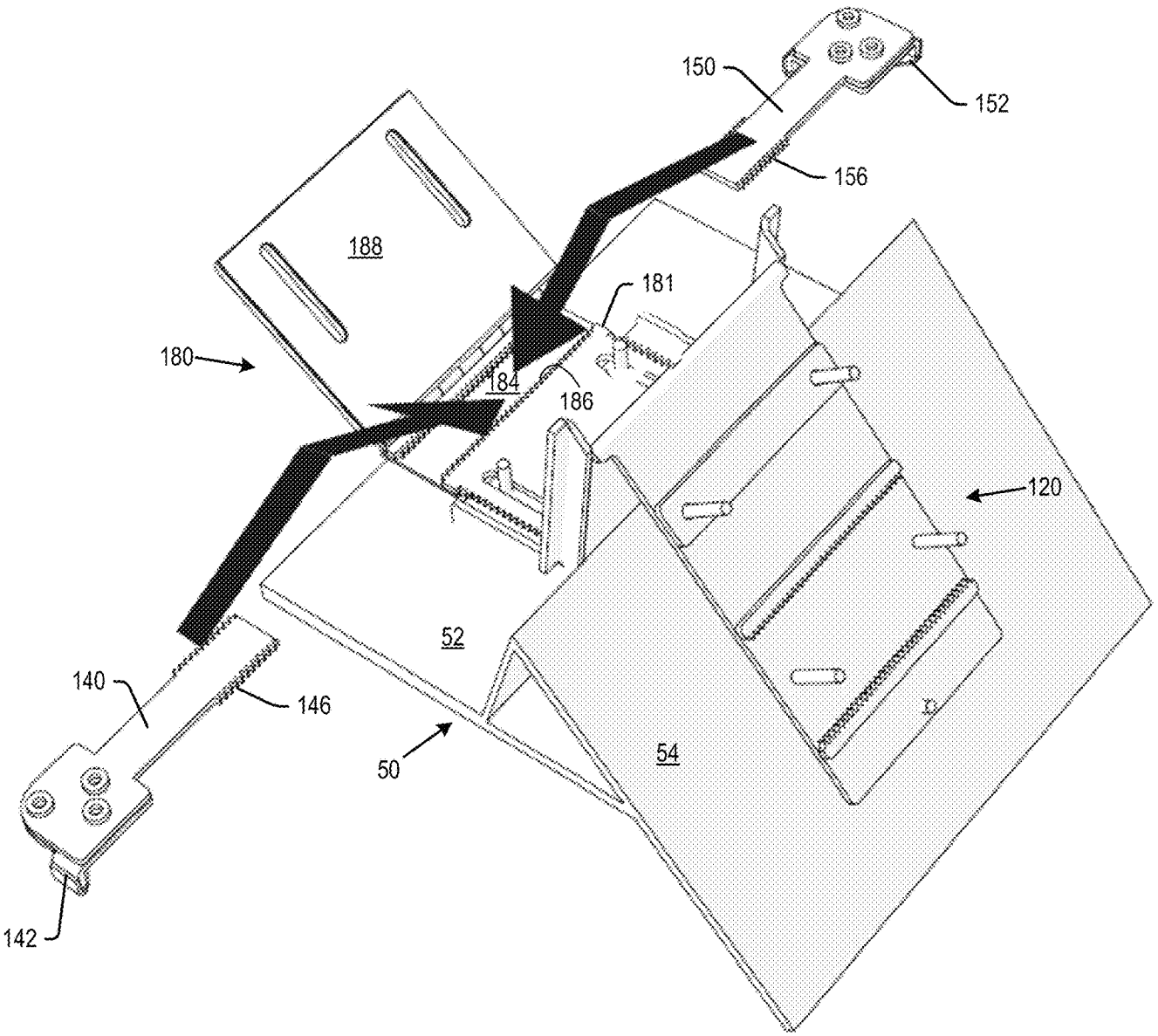
FIGS. 7A and 7B are perspective views showing left and right top corner clips being affixed to a back support plate of an apparatus according to embodiments of the present technology.
Figure 7B:
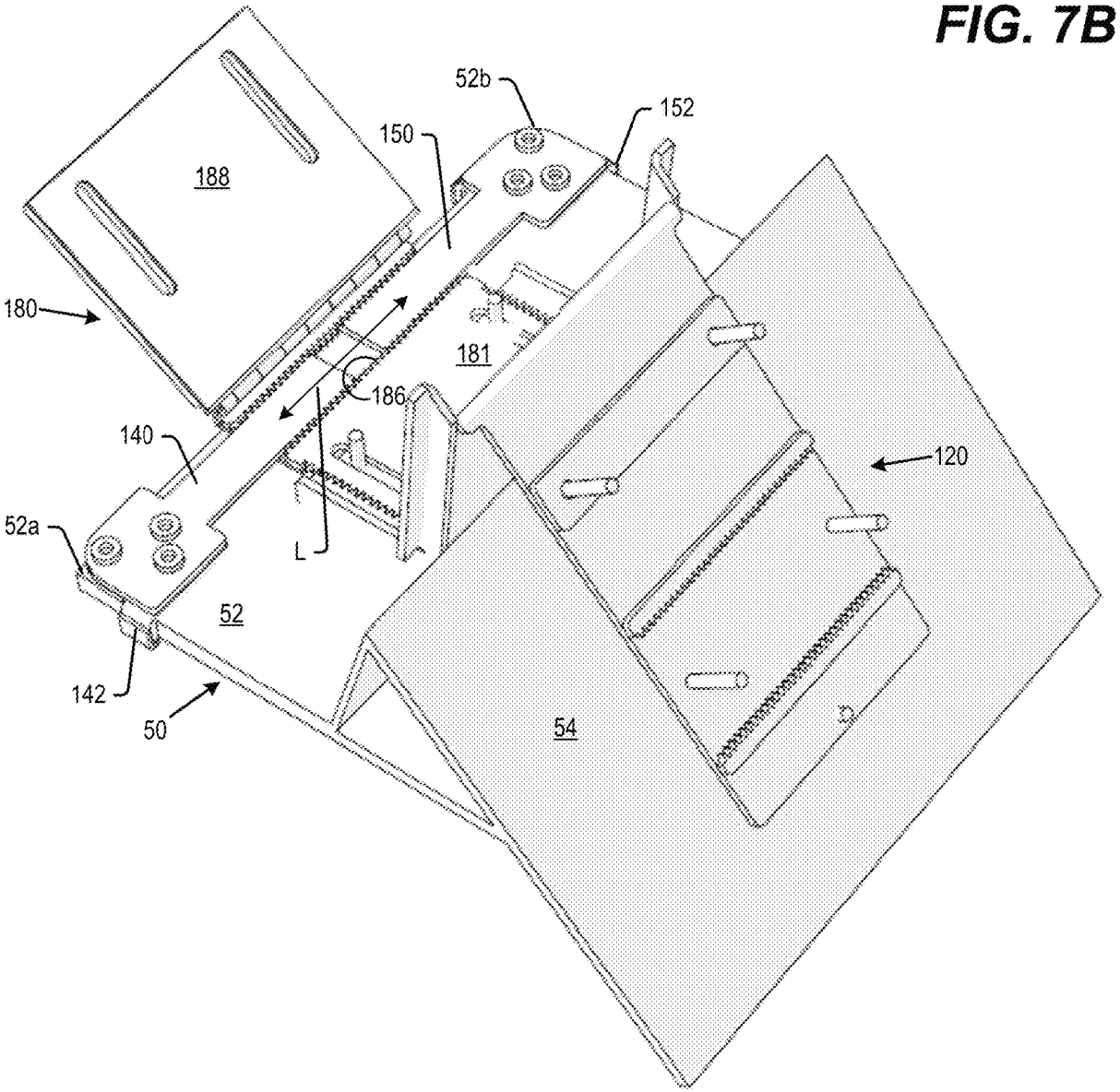

In step 210, the tooth plates 144, 154 of the left and right top corner clips 140, 150 are positioned within the recess 184 of the back support plate 180 as shown in FIGS. 7A and 7B. The lateral spacing of the left and right top corner clips 140, 150 are adjustable along arrow L, i.e., laterally, to position the brackets 142, 152 of the left and right top corner clips 140, 150 snugly over the corners 52*a*, 52*b* of the tablet 52. Once the proper lateral spacing of left and right top corner clips 140, 150 is adjusted to the width between the corners 52*a*, 52*b* of the tablet 52, the lateral spacing of the left and right top corner clips 140, 150 may be fixed by meshing teeth 146, 156 of the clips 140, 150 with teeth 186 of the back support plate 180. Thus, the lateral spacing of the clips 140, 150 may be adjusted to accommodate tablets 52 of different widths.

Figure 8A:
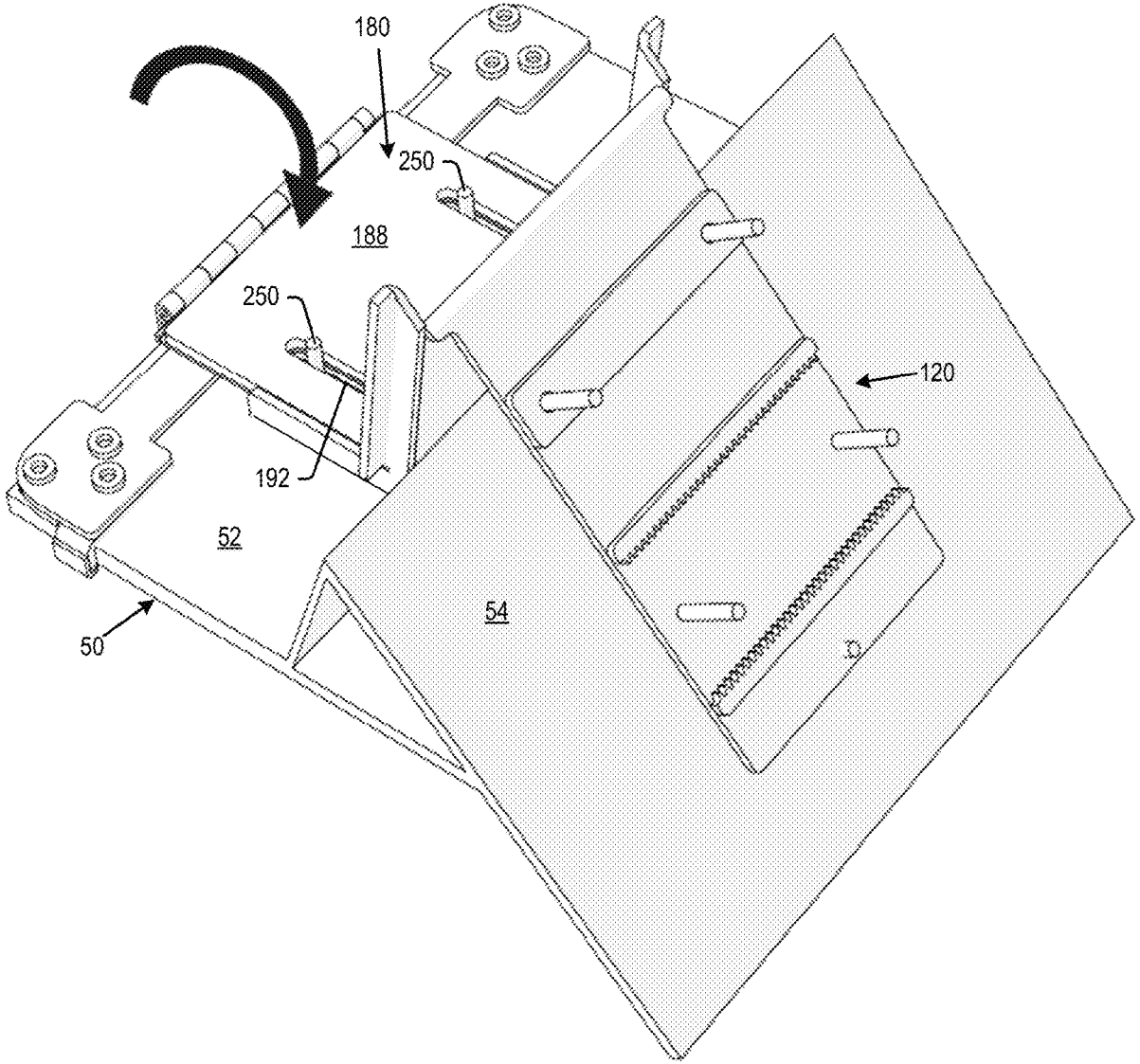
FIGS. 8A and 8B are perspective views showing the closing and securing of a back support plate of an apparatus according to embodiments of the present technology.
Figure 8B:
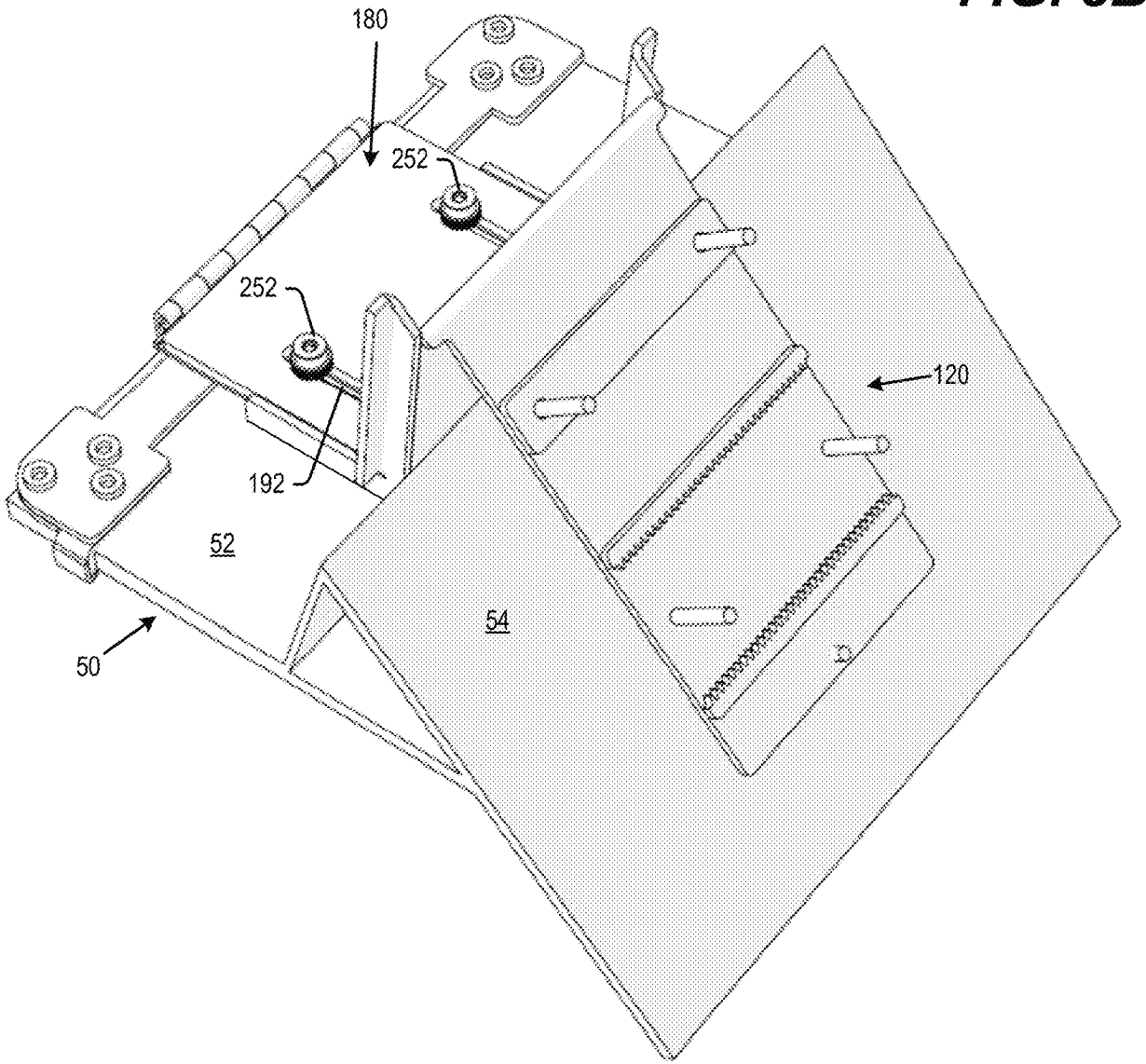
Figure 9A:
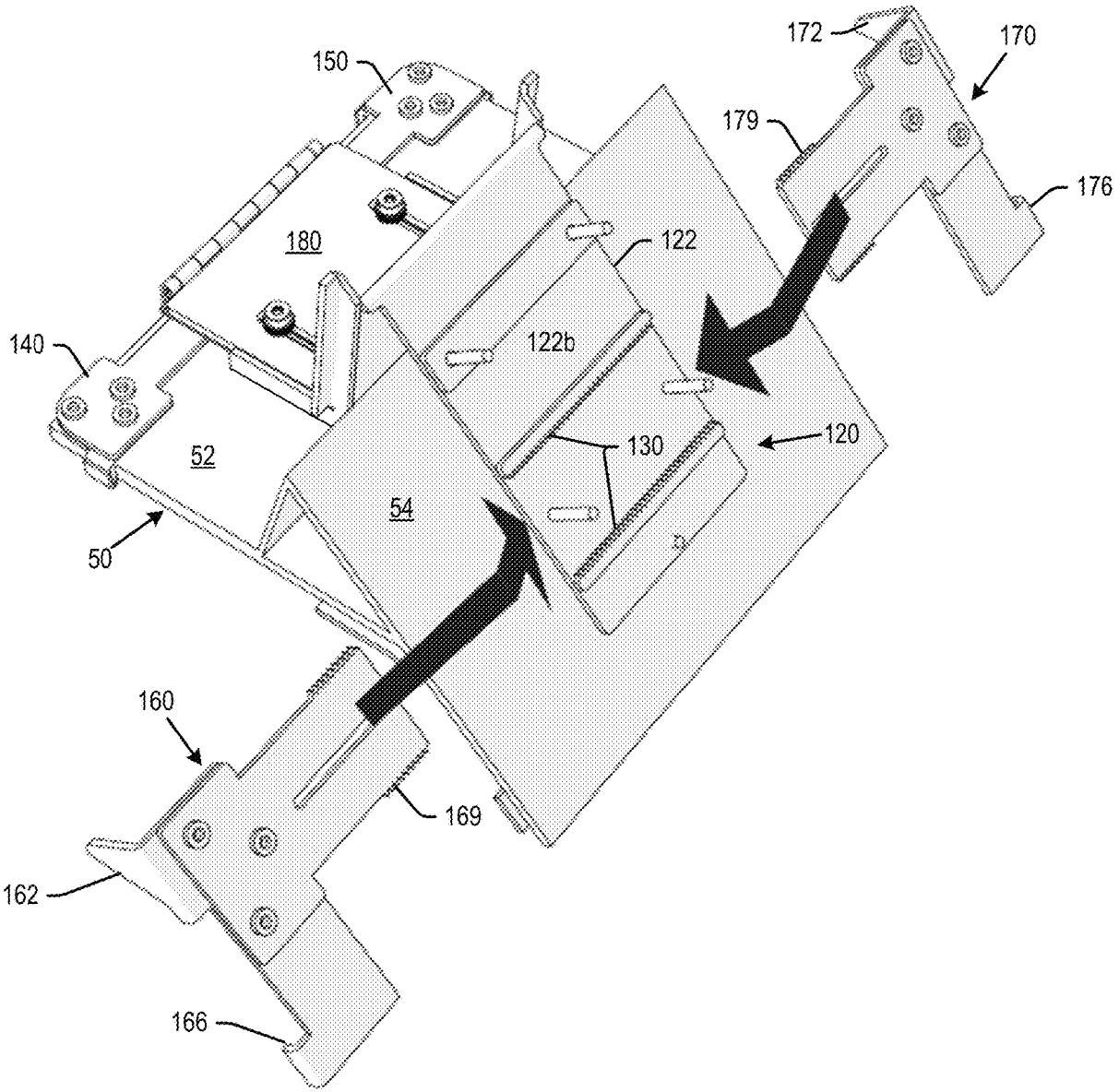
FIGS. 9A and 9B are perspective views showing left and right bottom corner clips being affixed to a baseplate of an apparatus according to embodiments of the present technology.
Figure 9B:
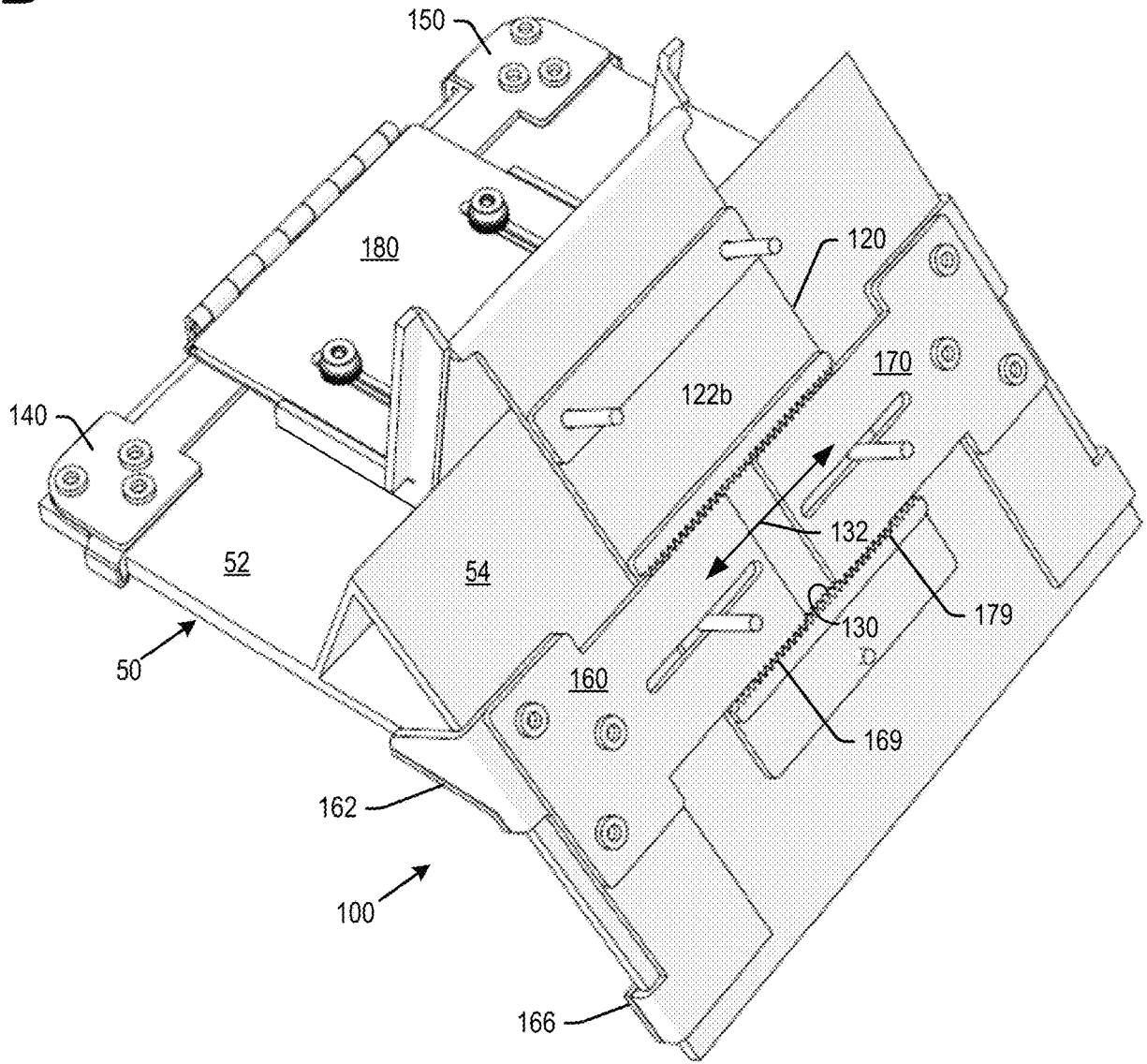

In step 212, the back support plate 180 may be closed as shown in FIG. 8A by closing the second plate over the first plate 181 to lock the left and right top clips 140, 150 in position. Screws (or other posts) 250 may protrude from the rear surface of the cover plate 126 of baseplate 120 as shown for example in FIGS. 5 and 8A. The screws 250 protrude through slots 192 in the back support plate 180. The back support plate may be locked in position by nuts (or other fasteners) 252 positioned over screws 250 as shown in FIG. 8B.

In step 214, the left and right bottom corner clips 160, 170 may be positioned on the rear surface 122*b* of the base 122 of baseplate 120 as shown in FIGS. 7A and 7B. The lateral spacing of the left and right bottom corner clips 160, 170 are adjustable along arrow 132 to position the left and right bottom corner clips in tight engagement with the tablet 52 and keyboard 54. In particular, once properly adjusted, the flange 162 of clip 160 engages and retains both the tablet 52 and keyboard 54 at the interface where the tablet attaches to the keyboard. The flange 164 of clip 160 engages and retains keyboard 54. Likewise, once properly adjusted, the flange 172 of clip 170 engages and retains both the tablet 52 and keyboard 54 at the interface where the tablet attaches to the keyboard. The flange 174 of clip 170 engages and retains keyboard 54.

Once the lateral spacing of left and right bottom corner clips 160, 170 is adjusted to the width of the tablet 52 and keyboard 54, the lateral spacing of the left and right bottom corner clips 160, 170 may be fixed by meshing teeth 169, 179 of the clips 160, 170 with teeth 130 of the baseplate 120. Thus, the lateral spacing of the clips 160, 170 may be adjusted to accommodate tablets and keyboards of different widths.

Figure 10A:
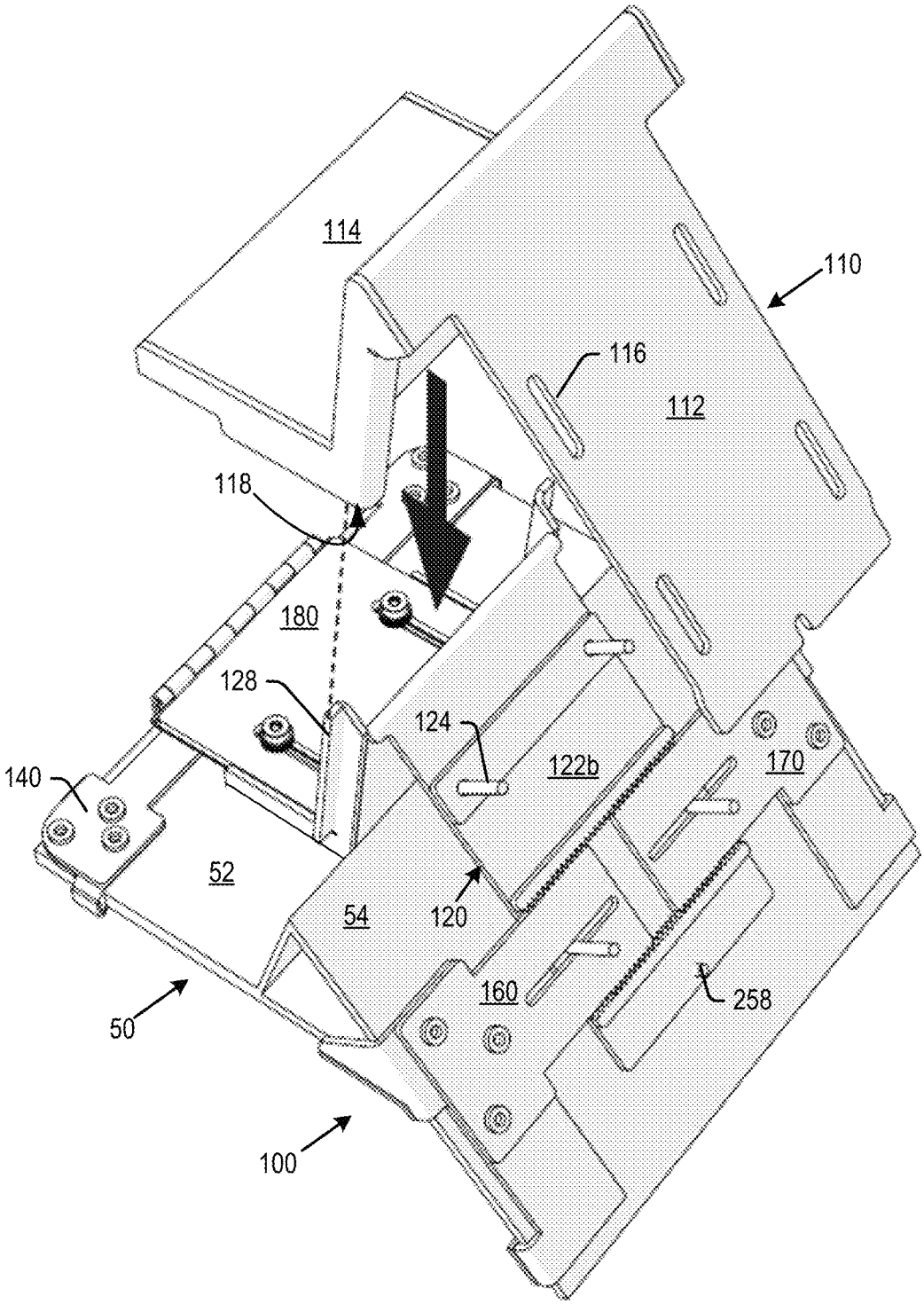
FIGS. 10A and 10B are perspective views showing a bottom cover plate being affixed to a baseplate of an apparatus according to embodiments of the present technology.
Figure 10B:
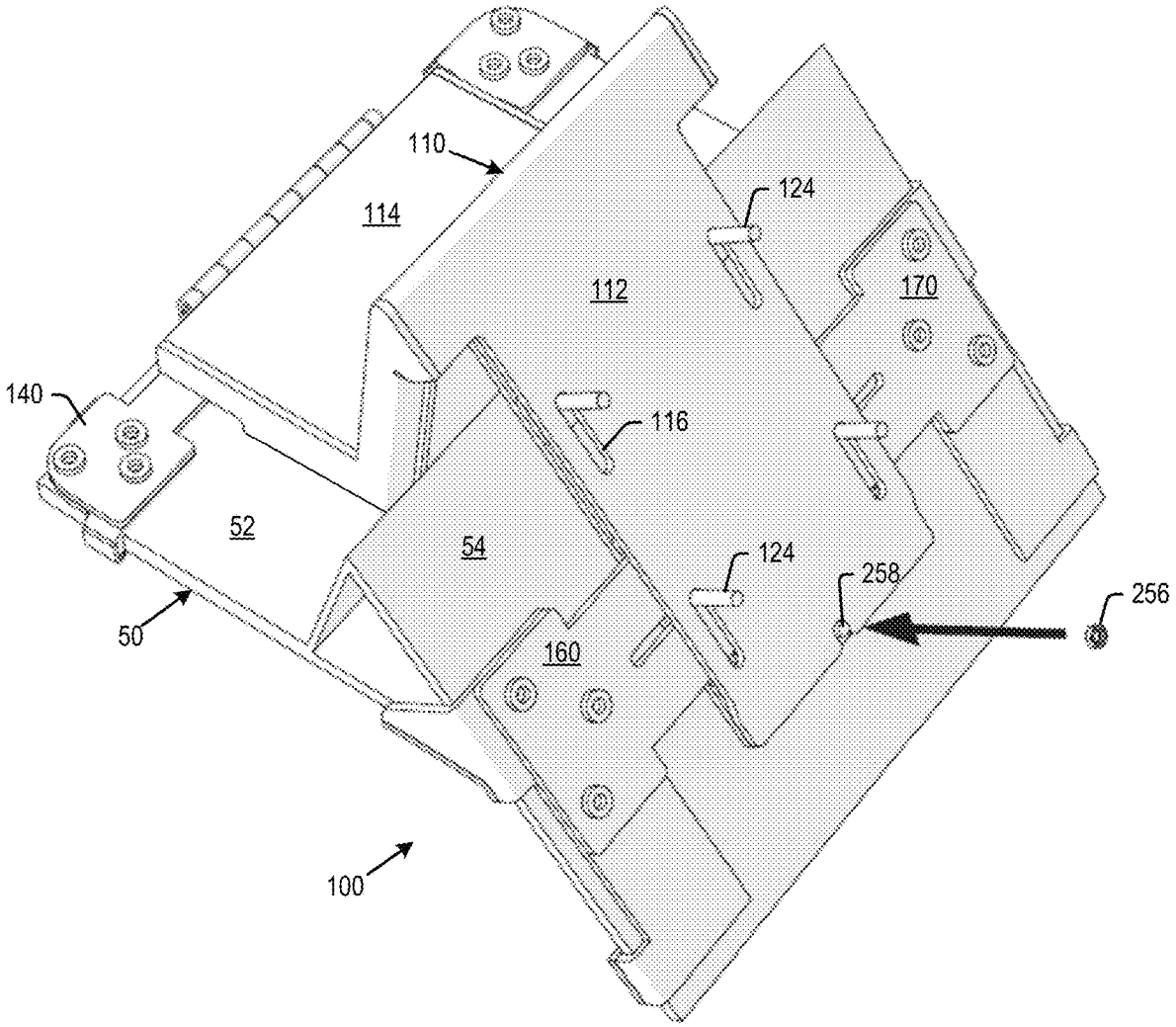

In step 216, the bottom cover plate 110 may be slid over, and affixed to, the baseplate 120 as shown in FIGS. 10A and 10B. As noted above, the cover section 114 of bottom cover plate 110 includes slots 118 that slide over rails 128 of a baseplate 120 to fix a position of the bottom cover plate 110 over the baseplate 120. As the bottom cover plate 110 slides over the baseplate 120, screws (or other fasteners) 124 protruding from rear surface 122*b* of baseplate 120 are received within holes 116 of base section 112 of bottom cover plate 110. The bottom cover plate 110 may be locked in position on top of baseplate 120, for example by means of a nut 256 fitting over a screw 258 mounted on the baseplate 120. Fastening the bottom cover plate 110 to the baseplate 120 locks the left and right bottom clips 160 and 170 in place in the baseplate 120.

At this point, the tablet 52 and keyboard 54 are securely locked into the apparatus 100. Moreover, aside from bottom cover plate 110 (which gets fastened to the display table 60 as explained below), no components of the apparatus 100 may be disassembled by hand from apparatus 100. Thus, the computing system 50 is secured within the apparatus 100 and may not be removed once the apparatus 100 is fastened to the display table 60. All components of the apparatus 100 described above may be formed of high-grade steel, or other materials that cannot be bent or deformed by hand.

Figure 11A:
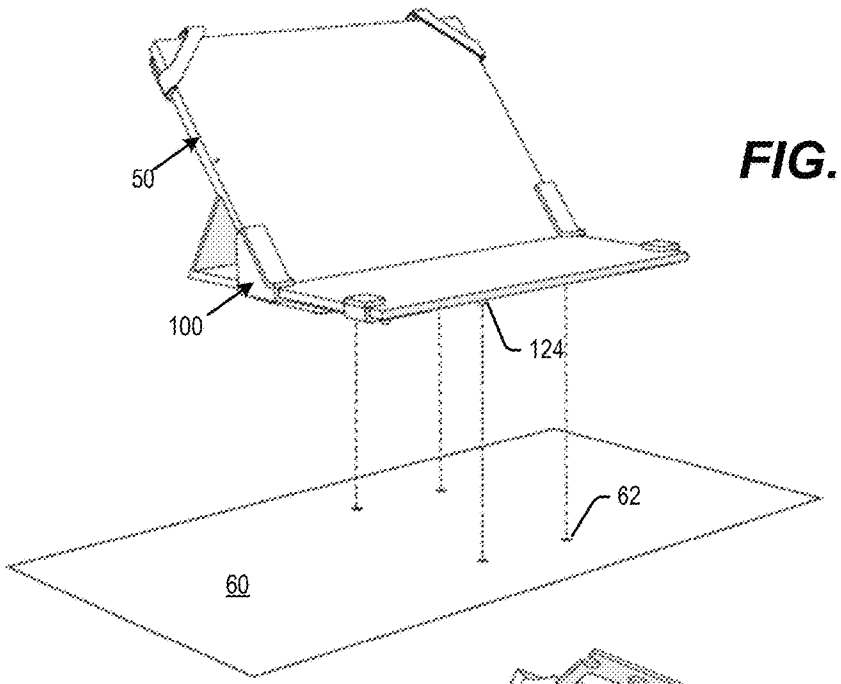
FIGS. 11A and 11B are top and bottom perspective views, respectively, showing an apparatus according to embodiments of the present technology being affixed to a display table.
Figure 11B:
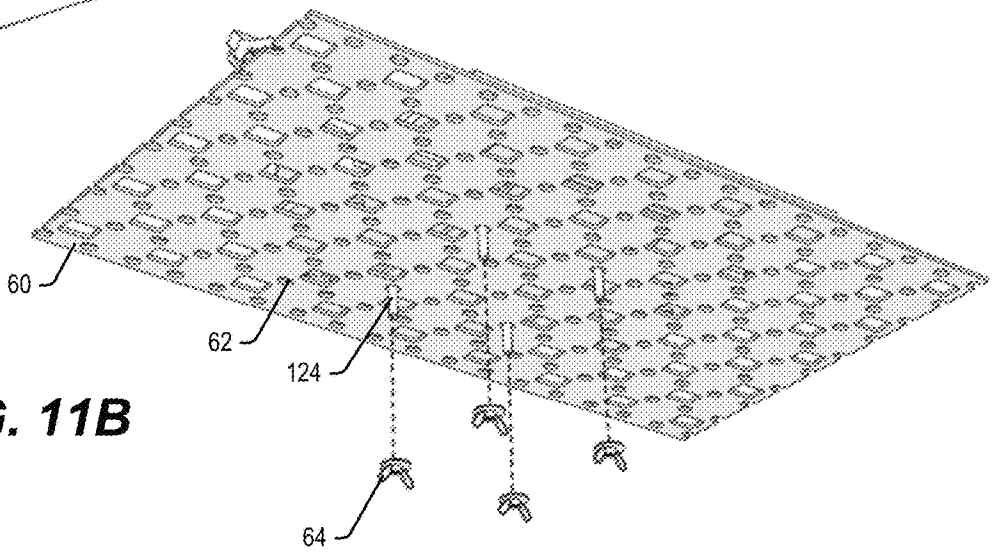

In step 218, the apparatus 100 and computing device 50 may be affixed to a display table 60 as shown in the top and bottom perspective views of FIGS. 11A and 11B. As shown, the screws 124 from the baseplate 120 are positioned to fit within holes 62 in the surface of display table 60. As seen in the bottom view of FIG. 11B, once properly seated on the display table 60, nuts 64 (or other fasteners) may be affixed to the screws 124 to lock the apparatus 100 on the display table 60.

The underside of table 60 is in a space that is not publicly accessible. That is, the space beneath display table 60 may be a secure enclosure accessible only to authorized personnel who, for example, have a key to unlock the secure enclosure, and not accessible to the general public viewing the secured object. Such authorized personnel may access the space beneath display table 60 to secure the apparatus 100 to the display table 60 by screws 124. Thereafter, the authorized personnel may lock the enclosure or space beneath the display table 60.

In one example, the nuts 64 fitting over the screws 124 may be wing nuts that can be affixed to the screws 124 using only a person's fingers. In embodiments, all components of the apparatus 100 may advantageously be affixed to each other and display table 60 without the need for any handheld tools. As such, the costs associated with such tools are eliminated, and there is no concern of needing to store tools or of losing and needing to replace such tools.

It is understood that the apparatus 100 may be affixed to the display table 60 by fasteners other than screws 124. For example, screws 124 may be omitted and replaced by threaded holes formed for example in bottom cover plate 110 and possibly baseplate 120. In such embodiments, screws (including for example wing screws) may then be inserted through holes 62 from an underside of display table 60 into the threaded holes in the bottom cover plate 110 to affix the apparatus 100 to the display table 60. In further embodiments, the bottom cover plate 110 and possibly baseplate 120 may have holes (not threaded) for receiving toggle anchor bolts from the underside of display table 60. The toggle anchors may be inserted through the holes and opened, and then the bolts tightened down onto the underside of the display table 60. Other fasteners are contemplated for affixing the apparatus 100 to the display table 60, which fasteners are not accessible from the top of surface of the display table 60.

In embodiments described above, the apparatus 100 may lock or otherwise securely affix a computing device 50 to the display table 60. It is an advantageous feature of the apparatus 100 that it may work to secure computing devices having a variety of different dimensions. For example, the teeth on each of the top and bottom clips 140, 150, 160 and 170 allow the clips to be adjusted laterally inward or outward to accommodate tablets 52 and keyboards 54 of different widths. Once adjusted to the proper lateral position, the teeth lock the clips in that position. Similarly, the teeth on the back support plate 180 allow support plate 180, and top clips 40, 150 affixed thereto, to be adjusted up or down to accommodate tablets 52 of different heights. Once adjusted to the proper height, the teeth lock the back support plate 180 in that position.

Figure 12:
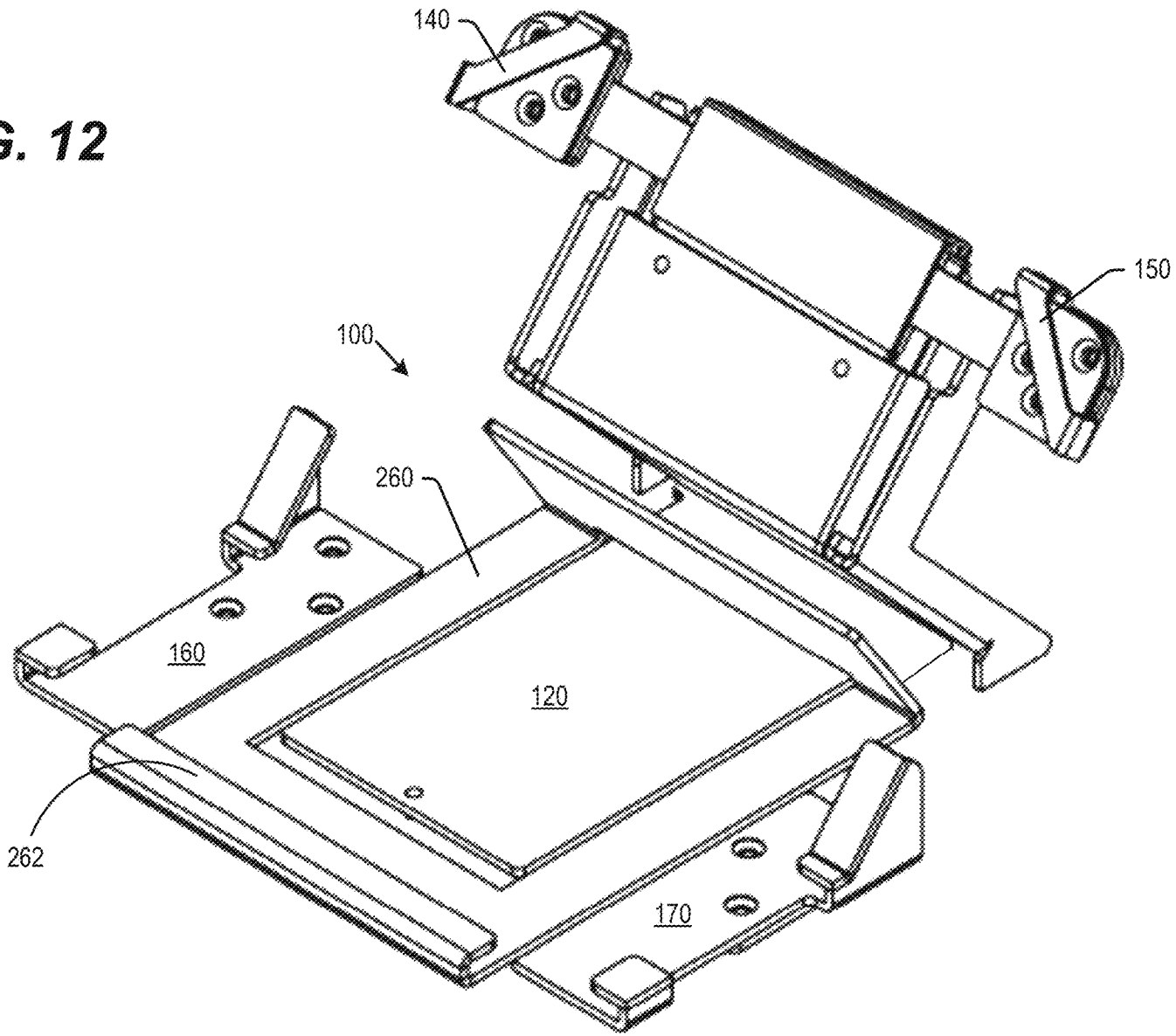
FIG. 12 is a perspective view of an apparatus according to an alternative embodiment including a keyboard bracket

In embodiments, the front of the keyboard 54 is left open (that is, not engaged by apparatus 100). As the keyboard 54 is affixed to the tablet 52, the keyboard 54 may not be removed. However, in further embodiments, a keyboard bracket 260 may be affixed to the baseplate 120 as shown for example in FIG. 12. The keyboard bracket 260 may have a front lip 262 to receive a front edge of the keyboard 54 in further lock the computing device 50 within apparatus 100. Although not shown, the keyboard bracket 260 may include teeth as described above to allow the keyboard bracket 260 to be adjusted to different sizes of keyboards 54.

In embodiments described above, the apparatus 100 includes components for securing a computing device including both a tablet 52 and keyboard 50 to a display table. The same apparatus 100 may be used to secure a computing device including only a tablet 52 (i.e., no keyboard 50). In further embodiments, in order to secure a computing device having only a tablet 52, the apparatus 100 may be modified, for example to remove the flange is 166 and 176 on the left and right bottom corner clips 160 and 170.

In summary, in one example, the present technology relates to an apparatus configured to secure both a tablet and a keyboard to a display table, wherein the keyboard is attachable to and detachable from the tablet, the apparatus comprising: a baseplate; a first set of clips having first ends connected to the baseplate and second ends opposite the first ends configured to engage and restrain portions of the tablet, the positions of the first ends with respect to the baseplate being adjustable to accommodate tablets of different sizes; and a second set of clips having third ends connected to the baseplate and fourth ends opposite the third ends configured to engage and restrain portions of the keyboard, the positions of the third ends with respect to the baseplate being adjustable to accommodate keyboards of different sizes.

In another example, the present technology relates to an apparatus configured to secure both a tablet and a keyboard to a display table, wherein the keyboard is attachable to and detachable from the tablet, the apparatus comprising: a baseplate having a portion configured to be secured to the display table; a back support plate connected to the baseplate and configured for longitudinal adjustment with respect to the baseplate; a first pair of clips connected to the back support plate and configured for lateral adjustment with respect to the back support plate and each other, the first pair of clips configured to engage and restrain portions of the tablet; and a second pair of clips connected to the baseplate and configured for lateral adjustment with respect to the baseplate and each other, the second pair of clips configured to engage and restrain portions of the keyboard.

In another example, the present technology relates to an apparatus configured to secure both a tablet and a keyboard to a display table, wherein the keyboard is attachable to and detachable from the tablet, the apparatus comprising: a baseplate having a portion configured to be secured to the display table, the baseplate comprising first and second sets of teeth; a back support plate directly connected to the baseplate, the back support plate comprising a third and fourth sets of teeth, the third set of teeth meshing with the first set of teeth of the baseplate such that the back support plate is configured for longitudinal adjustment with respect to the baseplate; a first pair of clips directly connected to the back support plate, the first pair of clips including fifth and sixth sets of teeth, respectively, the fifth and sixth sets of teeth meshing with the fourth set of teeth on the back support plate such that the first pair of clips are configured for lateral adjustment with respect to the back support plate and each other, the first pair of clips configured to engage and restrain uppermost corners of the tablet; and a second pair of clips directly connected to the baseplate, the second pair of clips including seventh and eighth sets of teeth, respectively, the seventh and eighth sets of teeth meshing with the second set of teeth on the baseplate such that the second pair of clips are configured for lateral adjustment with respect to the baseplate and each other, the second pair of clips configured to engage and restrain the keyboard.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The aspects of the disclosure herein were chosen and described in order to best explain the principles of the disclosure and the practical application, and to enable others of ordinary skill in the art to understand the disclosure with various modifications as are suited to the particular use contemplated.

The disclosure has been described in conjunction with various embodiments. However, other variations and modifications to the disclosed embodiments can be understood and effected from a study of the drawings, the disclosure, and the appended claims, and such variations and modifications are to be interpreted as being encompassed by the appended claims. In the claims, the word "comprising" does not exclude other elements or steps, and the indefinite article "a" or "an" does not exclude a plurality.

For purposes of this document, it should be noted that the dimensions of the various features depicted in the figures may not necessarily be drawn to scale.

For purposes of this document, reference in the specification to "an embodiment," "one embodiment," "some embodiments," or "another embodiment" may be used to describe different embodiments or the same embodiment.

For purposes of this document, a connection may be a direct connection or an indirect connection (e.g., via one or more other parts). In some cases, when an element is referred to as being connected or coupled to another element, the element may be directly connected to the other element or indirectly connected to the other element via intervening elements. When an element is referred to as being directly connected to another element, then there are no intervening elements between the element and the other element.

For purposes of this document, without additional context, use of numerical terms such as a "first" object, a "second" object, and a "third" object may not imply an ordering of objects, but may instead be used for identification purposes to identify different objects.

The foregoing detailed description has been presented for purposes of illustration and description. It is not intended to be exhaustive or to limit the subject matter claimed herein to the precise form(s) disclosed. Many modifications and variations are possible in light of the above teachings. The described embodiments were chosen in order to best explain the principles of the disclosed technology and its practical application to thereby enable others skilled in the art to best utilize the technology in various embodiments and with various modifications as are suited to the particular use contemplated. It is intended that the scope be defined by the claims appended hereto.

What is claimed is:

1. An apparatus configured to secure both a tablet and a keyboard to a display table, wherein the keyboard is attachable to and detachable from the tablet, the apparatus comprising:

a baseplate having a portion oriented in a first plane configured to be secured to the display table;

a back support plate connected to the baseplate and configured for longitudinal adjustment in a second plane with respect to the baseplate, the second plane being divergent from the first plane;

a first pair of clips connected to the back support plate, and configured for lateral adjustment with respect to the back support plate and each other, the first pair of clips configured to engage and restrain portions of the tablet; and a second pair of clips connected to the baseplate and configured for lateral adjustment with respect to the baseplate and each other, the second pair of clips configured to engage and restrain portions of the keyboard;

wherein the first set of clips are configured to engage a pair of laterally opposed corners of the tablet.

2. The apparatus of claim 1, wherein the pair of laterally opposed corners of the tablet are an uppermost pair of laterally opposed corners of the tablet.

3. The apparatus of claim 1, wherein the second set of clips are configured to engage a pair of laterally opposed corners of the keyboard.

4. The apparatus of claim 3, wherein the second set of clips are further configured to engage a pair of laterally opposed corners of the tablet.

5. The apparatus of claim 1, wherein the first set of clips are directly connected and laterally adjustably connected to the back support plate by inter-meshing teeth on the first set of clips and back support plate.

6. The apparatus of claim 1, wherein the second set of clips are directly connected and laterally adjustably connected to the baseplate by inter-meshing teeth on the second set of clips and baseplate.

7. An apparatus configured to secure both a tablet and a keyboard to a display table, wherein the keyboard is attachable to and detachable from the tablet, the apparatus comprising:

a baseplate having a portion configured to be secured to the display table, the baseplate comprising first and second sets of teeth;

a back support plate directly connected to the baseplate, the back support plate comprising a third and fourth sets of teeth, the third set of teeth meshing with the first set of teeth of the baseplate such that the back support plate is configured for longitudinal adjustment with respect to the baseplate;

a first pair of clips directly connected to the back support plate, the first pair of clips including fifth and sixth sets of teeth, respectively, the fifth and sixth sets of teeth meshing with the fourth set of teeth on the back support plate such that the first pair of clips are configured for lateral adjustment with respect to the back support plate and each other, the first pair of clips configured to engage and restrain uppermost corners of the tablet; and a second pair of clips directly connected to the baseplate, the second pair of clips including seventh and eighth sets of teeth, respectively, the seventh and eighth sets of teeth meshing with the second set of teeth on the baseplate such that the second pair of clips are configured for lateral adjustment with respect to the baseplate and each other, the second pair of clips configured to engage and restrain the keyboard.

8. The apparatus of claim 7, wherein the second pair of clips are also configured to engage and restrain portions of the tablet.

9. The apparatus of claim 7, wherein the first and second sets of clips are not manually adjustable or removable from the apparatus when the first and second sets of clips are assembled into the apparatus and the baseplate is mounted on the display table.

10. An apparatus configured to secure a computing device to a display table, comprising:

a first corner clip configured to engage a first corner of the computing device, and a second corner clip configured to engage a second corner of the computing device, adjacent to the first corner, the first and second corner clips configured to restrain the computing device along first and second orthogonal axes, wherein the pair of corner clips are adjustable along the first axis, and the pair of corner clips are adjustable along the second axis independently of the adjustment along the first axis to accommodate computing devices of different sizes;

wherein at least one of the first and second corner clips comprise a first set of teeth configured to engage a second set of teeth in the apparatus, at least one of the first and second corner clips being adjustable along one of the first and second axes by changing a position of the first set of teeth relative to the second set of teeth.

11. The apparatus of claim 10, wherein the first and second corner clips comprise left and right top corner clips.

12. The apparatus of claim 11, further comprising:

a left bottom corner clip configured to engage a third corner of the computing device, and a right bottom corner clip configured to engage a fourth corner of the computing device, adjacent to the third corner, wherein the left and right bottom corner clips are adjustable along the first axis and along the second axis to accommodate computing devices of different sizes.

13. The apparatus of claim 12, wherein at least one of the left and right corner clips comprise a third set of teeth configured to engage a fourth set of teeth in the apparatus, at least one of the left and right corner clips being adjustable along one of the first and second axes by changing a position of the third set of teeth relative to the fourth set of teeth.

14. The apparatus of claim 12, wherein the computing device comprises both a tablet and a keyboard, the left and right bottom corner clips restraining both the tablet and the keyboard.

15. The apparatus of claim 12, wherein the left and right top corner clips and the left and right bottom corner clips cannot be removed by hand from the apparatus when the apparatus is assembled on a display table.

16. An apparatus configured to secure a computing device to a display table, comprising:

a first pair of opposed racks of teeth;

a pair of corner clips comprising a second pair of opposed racks of teeth, the pair of corner clips configured to engage first and second corners of the computing device;

wherein the second pair of opposed racks of teeth is configured to engage the first pair of opposed racks of teeth to secure the pair of corner clips in the apparatus.

17. The apparatus of claim 7, wherein a spacing between the pair of corner clips is adjustable by changing a position of the teeth in the first pair of opposed racks of teeth relative to the teeth in the second pair of opposed racks of teeth.

18. The apparatus of claim 8, wherein the first pair of opposed racks of teeth are formed in support plate supporting the pair of corner clips, wherein the support plate includes a third pair of opposed racks of teeth configured to mate with a fourth pair of opposed racks of teeth in the apparatus, a position of the support plate being adjustable in the apparatus by changing a position of the teeth in the third pair of opposed racks of teeth relative to the teeth in the fourth pair of opposed racks of teeth.

19. An apparatus configured to secure both a tablet and a keyboard to a display table, wherein the keyboard is attachable to and detachable from the tablet, the apparatus comprising:

a baseplate having a portion oriented in a first plane configured to be secured to the display table;

a back support plate connected to the baseplate and configured for longitudinal adjustment in a second plane with respect to the baseplate, the second plane being divergent from the first plane;

a first pair of clips connected to the back support plate, and configured for lateral adjustment with respect to the back support plate and each other, the first pair of clips configured to engage and restrain portions of the tablet; and a second pair of clips connected to the baseplate and configured for lateral adjustment with respect to the baseplate and each other, the second pair of clips configured to engage and restrain portions of the keyboard;

wherein the back support plate is directly connected and longitudinally adjustably connected to the baseplate by inter-meshing teeth on the back support plate and baseplate.

20. The apparatus of claim 19, wherein the first set of clips are configured to engage a pair of laterally opposed corners of the tablet.

21. The apparatus of claim 20, wherein the pair of laterally opposed corners of the tablet are an uppermost pair of laterally opposed corners of the tablet.

22. The apparatus of claim 19, wherein the second set of clips are configured to engage a pair of laterally opposed corners of the keyboard.

23. The apparatus of claim 22, wherein the second set of clips are further configured to engage a pair of laterally opposed corners of the tablet.

24. The apparatus of claim 19, wherein the first set of clips are directly connected and laterally adjustably connected to the back support plate by inter-meshing teeth on the first set of clips and back support plate.

25. The apparatus of claim 19, wherein the second set of clips are directly connected and laterally adjustably connected to the baseplate by inter-meshing teeth on the second set of clips and baseplate.

* * * * *